US012134826B2

(12) United States Patent
Huang et al.

(10) Patent No.: US 12,134,826 B2
(45) Date of Patent: Nov. 5, 2024

(54) $CO_2$ ELECTROREDUCTION TO MULTI-CARBON PRODUCTS IN STRONG ACID

(71) Applicants: TOTALENERGIES ONETECH, Courbevoie (FR); THE GOVERNING COUNCIL OF THE UNIVERSITY OF TORONTO, Toronto (CA)

(72) Inventors: Jianan Erick Huang, Toronto (CA); Fengwang Li, Toronto (CA); Adnan Ozden, Toronto (CA); David Sinton, Toronto (CA); Edward Sargent, Toronto (CA)

(73) Assignees: TOTALENERGIES ONETECH, Courbevoie (FR); THE GOVERNING COUNCIL OF THE UNIVERSITY OF TORONTO, Toronto (CA)

( * ) Notice: Subject to any disclaimer, the term of this patent is extended or adjusted under 35 U.S.C. 154(b) by 0 days.

(21) Appl. No.: 18/279,453

(22) PCT Filed: Mar. 4, 2022

(86) PCT No.: PCT/EP2022/055570

§ 371 (c)(1),
(2) Date: Aug. 30, 2023

(87) PCT Pub. No.: WO2022/184905

PCT Pub. Date: Sep. 9, 2022

(65) Prior Publication Data

US 2024/0093390 A1 Mar. 21, 2024

Related U.S. Application Data

(60) Provisional application No. 63/200,393, filed on Mar. 4, 2021.

(30) Foreign Application Priority Data

Mar. 22, 2021 (LU) ..... 102678

(51) Int. Cl.
*C25B 11/081* (2021.01)
*C25B 3/26* (2021.01)
(Continued)

(52) U.S. Cl.
CPC ..... *C25B 11/081* (2021.01); *C25B 3/26* (2021.01); *C25B 13/08* (2013.01); *C25B 15/031* (2021.01)

(58) Field of Classification Search
None
See application file for complete search history.

(56) References Cited

U.S. PATENT DOCUMENTS

2013/0180865 A1* 7/2013 Cole ..... C25B 15/00 204/252
2013/0228470 A1 9/2013 Chen
(Continued)

FOREIGN PATENT DOCUMENTS

EP 3536823 A1 9/2019
WO WO-2019025092 A1 * 2/2019
(Continued)

OTHER PUBLICATIONS

Machine translation of WO-2019025092-A1 (Year: 2019).*
(Continued)

*Primary Examiner* — Harry D Wilkins, III
(74) *Attorney, Agent, or Firm* — Ewing & Jones, PLLC

(57) ABSTRACT

The present disclosure relates to an electrode for $CO_2$ electroreduction in an acidic electrolyte comprising cation species, the electrode comprising: a substrate, a metal-based catalyst material, and a cation-augmenting material; wherein
(Continued)

the cation-augmenting material comprises an acidic group exchanging protons with the cation species of the acidic electrolyte so as to increase a concentration of the cation species at a surface of the electrode.

14 Claims, 28 Drawing Sheets

(51) Int. Cl.
*C25B 13/08* (2006.01)
*C25B 15/031* (2021.01)

(56) References Cited

U.S. PATENT DOCUMENTS

2017/0167038 A1* 6/2017 Hashiba ..... C25B 11/044
2021/0207275 A1* 7/2021 Huo ..... C25B 9/23
2021/0218036 A1* 7/2021 Sargent ..... C25B 11/031

FOREIGN PATENT DOCUMENTS

WO 2019051609 A1 3/2019
WO 2021089508 A1 5/2021

OTHER PUBLICATIONS

Hailu et al, Implications of Surface Strain for Enhanced Carbon Dioxide Reduction on Copper-Silver Alloys, Journal of the Electrochemical Society, vol. 167, No. 12, Aug. 2020, 126509 pp. 1-6 (Year: 2020).*
Sumner et al, Proton Conductivity in Nafion® 117 and in a Novel Bis[(perfluoroalkyl)sulfonyl]imide Ionomer Membrane, Journal of the Electrochemical Society, vol. 145, No. 1, Jan. 1998, pp. 107-110 (Year: 1998).*
Haiping Xu et al., "Highly selective electrocatalytic CO2 reduction to ethanol by metallic clusters dynamically formed from atomically dispersed copper", Nature Energy, vol. 5; Aug. 2020; pp. 623-632.
International Search Report and Written Opinion issued in Application No. PCT/EP2022/055570, dated Oct. 6, 2022, 20 pages.
Singh Meenesh R. et al., "Hydrolysis of Electrolyte Cations Enhances the Electrochemical Reduction of CO 2 over Ag and Cu", Journal of the American Chemical Society, (20160926), vol. 138, No. 39, pp. 13006-13012.
S. Chu, et al., "Opportunities and challenges for a sustainable energy future", Nature 488, 294-303 (2012).
P. De Luna et al., "What would it take for renewably powered electrosynthesis to displace petrochemical processes?", Science 364, eaav3506 (2019) 11 pages.
S. Ren et al., "Molecular electrocatalysts can mediate fast, selective CO2 reduction in a flow cell", Science 365, 367-369 (2019).
Y. Wu, et al., "Domino electroreduction of CO2 to methanol on a molecular catalyst", Nature 575, 639-642 (2019) 17 pages.
B. A. Rosen et al., "Ionic liquid-mediated selective conversion of CO2 to CO at low overpotentials", Science 334, 643-644 (2011).
S. Weisenberger et al., "Estimation of gas solubilities in salt solutions at temperatures from 273 K to 363 K". AIChE J. 42, 298-300 (1996).
F. P. García de Arquer et al., "CO2 electrolysis to multicarbon products at activities greater than 1 A cm-2", Science 367, 661-666 (2020).
W. Ma et al., "Electrocatalytic reduction of CO2 to ethylene and ethanol through hydrogen-assisted C—C coupling over fluorine-modified copper", Nat. Catal. 3, 478-487 (2020).
J. A. Rabinowitz, et al., "The future of low-temperature carbon dioxide electrolysis depends on solving one basic problem", Nat. Commun. 11, 3964 (2020) 3 pages.
C.-T. Dinh et al., "CO2 electroreduction to ethylene via hydroxide-mediated copper catalysis at an abrupt interface", Science 360, 783-787 (2018).
T. Haas, et al., "Technical photosynthesis involving CO2 electrolysis and fermentation", Nat. Catal. 1, 32-39 (2018).
R. B. Kutz et al., "Sustainion imidazolium-functionalized polymers for carbon dioxide electrolysis", Energy Technol. 5, 929-936 (2017).
S. Verma et al., "Insights into the low overpotential electroreduction of CO2 to CO on a supported gold catalyst in an alkaline flow electrolyzer", ACS Energy Lett. 3, 193-198 (2018).
T. T. H. Hoang et al., "Nanoporous copper-silver alloys by additive-controlled electrodeposition for the selective electroreduction of CO2 to ethylene and ethanol", J. Am. Chem. Soc. 140, 5791-5797 (2018).
S. Ma et al., "One-step electrosynthesis of ethylene and ethanol from CO2 in an alkaline electrolyzer", J. Power Sources 301, 219-228 (2016).
D. W. Keith, et al., "A process for capturing CO2 from the atmosphere", Joule 2, 1573-1594 (2018).
M. Ma et al., "Insights into the carbon balance for CO2 electroreduction on Cu using gas diffusion electrode reactor designs", Energy Environ. Sci. 13, 977-985 (2020).
F. Li et al., "Molecular tuning of CO2-to-ethylene conversion", Nature 577, 509-513 (2020).
C. J. Bondue, et al., "Suppression of hydrogen evolution in acidic electrolytes by electrochemical CO2 reduction", J. Am. Chem. Soc. 143, 279-285 (2021).
Z. Wang, et al., "Acidic electrochemical reduction of CO2 using nickel nitride on multiwalled carbon nanotube as selective catalyst", ACS Sustain. Chem. Eng. 7, 6106-6112 (2019).
R. Kortlever, et al., "Electrochemical CO2 reduction to formic acid on a Pd-based formic acid oxidation catalyst", Catal. Today 244, 58-62 (2015).
H. Ooka, M. C. Figueiredo, M. T. M. Koper, Competition between hydrogen evolution and carbon dioxide reduction on copper electrodes in mildly acidic media. Langmuir 33, 9307-9313 (2017).
Y. Liu, C. C. L. McCrory, "Modulating the mechanism of electrocatalytic CO2 reduction by cobalt phthalocyanine through polymer coordination and encapsulation", Nat. Commun. 10, 1683 (2019) 10 pages.
Y. Wu et al., "Electrochemical CO2 reduction using gas diffusion electrode loading Ni-doped covalent triazine frameworks in acidic electrolytes", Electrochem. 88, 359-364 (2020).
J. Shen et al., "Electrocatalytic reduction of carbon dioxide to carbon monoxide and methane at an immobilized cobalt protoporphyrin", Nat. Commun. 6, 8177 (2015) 8 pages.
I. Katsounaros et al., "The effective surface pH during reactions at the solid-liquid interface", Electrochem. Commun. 13, 634-637 (2011).
N. Gupta, et al., "Calculation for the cathode surface concentrations in the electrochemical reduction of CO2 in KHCO3 solutions", J. Appl. Electrochem. 36, 161-172 (2006).
M. Jouny, et al., "General techno-economic analysis of CO2 electrolysis systems", Ind. Eng. Chem. Res. 57, 2165-2177 (2018).
A. Murata, Y. Hori, "Product selectivity affected by cationic species in electrochemical reduction of CO2 and CO at a Cu electrode", Bull. Chem. Soc. Jpn 64, 123-127 (1991).
S. Ringe et al., "Understanding cation effects in electrochemical CO2 reduction. Energy Environ", Sci. 12, 3001-3014 (2019).
J. Resasco et al., "Promoter effects of alkali metal cations on the electrochemical reduction of carbon dioxide", J. Am. Chem. Soc. 139, 11277-11287 (2017).
H. Zimmermann, R. Walzl, in Ullmann's Encyclopedia of Industrial Chemistry. (Wiley-VCH, 2009), vol. 13, "Ethylene", 66 pages.
J. H. Montoya, C. Shi, K. Chan, J. K. Nørskov, "Theoretical insights into a CO dimerization mechanism in CO2 electroreduction", J. Phys. Chem. Lett. 6, 2032-2037 (2015).
R. B. Sandberg, J. H. Montoya, K. Chan, J. K. Nørskov, "CO-CO coupling on Cu facets: Coverage, strain and field effects", Surf. Sci. 654, 56-62 (2016).
A. Ozden et al., "High-rate and efficient ethylene electrosynthesis using a catalyst/promoter/transport layer", ACS Energy Lett. 5, 2811-2818 (2020).
D. S. Ripatti, T. R. Veltman, M. W. Kanan, "Carbon monoxide gas diffusion electrolysis that produces concentrated C2 products with high single-pass conversion", Joule 3, 240-256 (2019).

(56) References Cited

OTHER PUBLICATIONS

C. M. Gabardo et al., "Continuous Carbon Dioxide Electroreduction to Concentrated Multi-carbon Products Using a Membrane Electrode Assembly", Joule 3, 2777-2791 (2019).
T. Burdyny & W. A. Smith, "CO2 reduction on gas-diffusion electrodes and why catalytic performance must be assessed at commercially-relevant conditions", Energy Environ. Sci. 12, 1442-1453 (2019).
P. K Das et al., "Effective transport coefficients in PEM fuel cell catalyst and gas diffusion layers: Beyond Bruggeman approximation", Appl. Energy 87, 2785-2796 (2010).
Newman et al., "Electrochemical Systems", 3rd Edition (2004) 30 pages.
D. M. Bernardi et al., "Mathematical model of a gas diffusion electrode bonded to a polymer electrolyte", AIChE Journal. 37, 1151-1163 (1991).
B. Kumar et al., "New trends in the development of heterogeneous catalysts for electrochemical CO2 reduction", Catal. Today 270, 19-30 (2016).
Y. Chen et al., "Modeling the Performance of a Flow-Through Gas Diffusion Electrode for Electrochemical Reduction of CO or CO2", J. Electrochem. Soc. (2020) 167, 8 pages.
A. Ozden et al., "Cascade CO2 electroreduction enables efficient carbonate-free production of ethylene". Joule, 5, 706-719 (2021).

* cited by examiner

$CO_2$ ELECTROREDUCTION TO MULTI-CARBON PRODUCTS IN STRONG ACID

CROSS-REFERENCE TO RELATED APPLICATIONS

This application claims the benefit of PCT/EP2022/055570 filed Mar. 4, 2022, which claims priority from U.S. 63/200,393 filed Mar. 4, 2021, and LU102678 filed Mar. 22, 2021, which are incorporated herein by reference in their entireties for all purposes.

TECHNICAL FIELD

Background

Electrochemical reduction of $CO_2$ ($CO_2R$) using renewable electricity offers an attractive approach to produce widely needed chemicals and feedstocks while mitigating greenhouse gas emissions (1, 2). Effort has been dedicated to developing catalysts that achieve high faradaic efficiency (FE) toward carbon monoxide and formate; and to promoting C—C coupling toward multi-carbon ($C_{2+}$) products such as ethylene and ethanol (3-6). Lowering overpotentials of these reactions and increasing their productivity (current density) have been priorities for the field (7, 8).

Despite many recent advances, $CO_2R$ remains far from practical viability because strong local alkaline conditions are present (FIG. 1). A major part of $CO_2$ is—rather than being reduced—consumed via reaction with hydroxide ions $OH^-$ from the electrolyte, leading to formation of carbonations ions $CO_3^{2-}$ according to Eq. 1:

$$2OH^-_{(aq)}+CO_{2(g)}\rightarrow CO_3^{2-}{}_{(aq)}+H_2O_{(aq)} \quad \text{(Eq. 1)}$$

Carbonate formation imposes a limit of carbon utilization efficiency (ratio of $CO_2$ converted to $CO_2R$ products to feeding $CO_2$) that is prohibitively low (9). For every proton/electron pair transferred during the $CO_2R$, one hydroxide is produced at the cathode, reacting with ½ $CO_2$ to form carbonate. As a result, the maximum carbon efficiency is 50% for two-electron-transfer processes such as $CO_2$ to CO.

For $CO_2R$ to more valuable $C_{2+}$ products, the effect is even more acute: the carbon efficiency of $CO_2R$ to ethylene/ethanol is limited to 25% as six electrons are needed per $CO_2$ reacted. In practice, due part to non-unity selectivity and use of alkaline electrolyte, the carbon efficiency is even lower than these best-case theoretical limits (FIG. 2) (7, 10-15).

Low carbon efficiency results in a significant energy penalty: the cost to regenerate the lost $CO_2$ (9, 16), which would otherwise be emitted again. Techno-economic analysis (TEA) of alkaline $CO_2$ electrolyzers shows that achieving high carbon utilization with these systems incurs a severe energy penalty, with over 50% of input energy used to regenerate $CO_2$ lost to carbonate (FIG. 3, tables 1 et 2).

TABLE 1

The operational cost breakdown of neutral $CO_2RR$ MEA electrolyzer and alkaline flow-cell electrolyzer in ideal scenario.

| Model input parameters | Neutral $CO_2R$ in MEA | Alkaline $CO_2R$ in flow cell |
|---|---|---|
| $CO_2$ input ($/ton) | 30 | 30 |
| $H_2O$ ($/ton) | 5 | 5 |
| Electrolyte | 0.1M $KHCO_3$ | 3M KOH |
| Electrolyte salts cost ($/ton) | 750 | 1000 |

TABLE 1-continued

The operational cost breakdown of neutral $CO_2RR$ MEA electrolyzer and alkaline flow-cell electrolyzer in ideal scenario.

| Model input parameters | Neutral $CO_2R$ in MEA | Alkaline $CO_2R$ in flow cell |
|---|---|---|
| Electrolyte lifetime (year) | 1 | 1 |
| Catalysts/Membrane lifetime (year) | 5 | 5 |
| System lifetime (year) | 30 | 30 |
| Electrolyzer cost ($/KW) | 300 | 300 |
| Electricity cost ($/kWh) | 0.03 | 0.03 |
| Balance of Plant (%) | 50 | 50 |
| Lang factor | 1 | 1 |
| Capacity factor | 0.9 | 0.9 |
| Cell voltage (V) | 3.7 | 2.5 |
| Faradaic efficiency (%) | 95 | 95 |
| Current density (A/cm$^2$) | 0.2 | 0.2 |
| Single pass conversion (%) | 23.75 | 4.5 |
| $CO_2$ crossover factor | 3 | 20 |
| Output product | $C_2H_4$ | $C_2H_4$ |

TABLE 2

Techno-economic assessment of neutral $CO_2R$ MEA electrolyzer and alkaline flow-cell electrolyzer, together with specific cost distribution per ton of ethylene produced.

| Cost distribution | Alkaline flow cell ($/ton) | Neutral MEA cell ($/ton) |
|---|---|---|
| Electrolyzer capital | 396.47 | 586.78 |
| Electrolyzer installation | 1125 | 1590.87 |
| Electrolyzer Operation | 264.32 | 391.19 |
| Cathode separation | 133.15 | 133.15 |
| Carbonate regeneration | 2317.54 | 0 |
| Anode separation | 0 | 509.79 |
| Summation | 4236.48 | 3211.78 |

$CO_2$ electrolyzers employing neutral electrolyte produce a local alkaline environment under operating conditions, and thus also suffer from carbonate formation and crossover (17, 18). The problem of inefficient $CO_2$ utilization in $CO_2R$ is central to the field and severely limits its prospects (9). While advances in FE and current density have been steady, the utilization challenge demands a new approach.

There are various challenges associated with carbon utilization in electrolytic systems. The present techniques address at least some of these challenges to achieve an enhanced carbon utilization in comparison to known techniques in the field.

SUMMARY $CO_2$ electroreduction ($CO_2RR$) is a promising route to convert the $CO_2$ that is contained in emissions into valuable chemicals and fuels. However, carbon utilization—that can be understood as a ratio of converted $CO_2$ to provided $CO_2$—can remain low, typically below 2% when converting of $CO_2$ into multicarbon products. This loss arises due to the consumption of $CO_2$ by local hydroxide ($OH^-$), to form carbonate in both alkaline and neutral electrolytes.

In a first aspect, the disclosure provides an electrolytic system for $CO_2$ electroreduction into multicarbon ($C_2^+$) products, the system comprising:

a cathode being an electrode for $CO_2$ electroreduction in an acidic electrolyte comprising cation species, the electrode comprising a substrate, a metal-based catalyst material and a cation-augmenting material, the cathode being provided in a catholyte chamber;

a catholyte being contained in the catholyte chamber for contacting the cathode, said catholyte being an acidic catholyte comprising cation species wherein the cation-augmenting material comprises an acid group exchanging protons with the cation species of the acid electrolyte so as to increase a concentration of the cation species at the surface of the electrode;

an anode being provided in an anolyte chamber;

an anolyte being contained in the anolyte chamber for contacting the anode;

a cationic exchange membrane;

a cathodic inlet in fluid communication with the cathode so as to feed the cathode with a gas component comprising $CO_2$; and a cathodic outlet in fluid communication the catholyte chamber so as to recover a product mixture comprising multicarbon ($C_2^+$) products;

the system being remarkable in that the cation species comprises one or more alkali metal ions, said alkali metal of said one or more alkali metal ions being selected from potassium, caesium or sodium, and the acidic catholyte further comprises at least one of chloride, phosphate monobasic, sulfate, iodide, and hydroxide of the selected alkali metal ions, and in that the catholyte has an alkali metal ion concentration between 0.5 M and 5 M.

With preference, the catholyte has an alkali metal ion concentration between 0.5 M and 4 M, or between 0.5 M and 3 M, preferably between 1 M and 2.5 M.

In particular, the disclosure provides an electrolytic system for $CO_2$ electroreduction into multicarbon ($C_2^+$) products, the system comprising:

a cathode being an electrode for $CO_2$ electroreduction in an acidic electrolyte comprising cation species, the electrode comprising a substrate, a metal-based catalyst material and a cation-augmenting material, the cathode being provided in a catholyte chamber;

a catholyte being contained in the catholyte chamber for contacting the cathode, said catholyte being an acidic catholyte comprising cation species wherein the cation-augmenting material comprises an acid group exchanging protons with the cation species of the acid electrolyte so as to increase a concentration of the cation species at the surface of the electrode;

an anode being provided in an anolyte chamber;

an anolyte being contained in the anolyte chamber for contacting the anode;

a cationic exchange membrane;

a cathodic inlet in fluid communication with the cathode so as to feed the cathode with a gas component comprising $CO_2$; and a cathodic outlet in fluid communication the catholyte chamber so as to recover a product mixture comprising multicarbon ($C_2^+$) products;

the system being remarkable in that the cation species comprise potassium ions K+, and the acidic catholyte further comprises at least one of potassium chloride, potassium phosphate monobasic, potassium sulfate, potassium iodide, and potassium hydroxide, and in that the catholyte has a K+ concentration between 0.5 M and 5 M or between 0.5 M and 3 M.

In fact, the electrolytic system for $CO_2$ electroreduction into multicarbon ($C_2^+$) products can be also defined as comprising:

a cathode being an electrode for $CO_2$ electroreduction in an acidic electrolyte comprising cation species, the electrode comprising a substrate, a metal-based catalyst material and a cation-augmenting material, wherein the cation-augmenting material comprises an acidic group exchanging protons with the cation species of the acidic electrolyte so as to increase a concentration of the cation species at a surface of the electrode, the cathode being provided in a catholyte chamber;

an anode being provided in an anolyte chamber;

an anolyte being contained in the anolyte chamber for contacting the anode;

a catholyte being contained in the catholyte chamber for contacting the cathode;

a cationic exchange membrane (CEM);

a cathodic inlet in fluid communication with the cathode so as to feed the cathode with a gas component comprising $CO_2$; and a cathodic outlet in fluid communication the catholyte chamber so as to recover a product mixture comprising multicarbon ($C_2^+$) products;

the system being remarkable in that the cation species comprise potassium ions K+, and the acidic catholyte further comprises at least one of potassium chloride, potassium phosphate monobasic, potassium sulfate, potassium iodide, and potassium hydroxide, and in that the catholyte has a K+ concentration between 0.5 M and 5 M, or between 0.5 M and 3 M.

The present techniques involve performing $CO_2RR$ in an acidic medium while avoiding domination of the hydrogen evolution reaction (i.e., $2H^+ + 2e^- \rightarrow H_2$) due to high proton availability at these acidic conditions. More specifically, there is proposed a cation fixation strategy that can enhance the availability of the one or more alkali metal ions, in particular potassium cations, in the vicinity of electrochemically active sites, overcoming hydrogen evolution and enabling efficient $CO_2R$ in acidic media through improved $CO_2$ adsorption and C—C coupling. Upon application of the cation fixation strategy, $CO_2RR$ can, for example, be achieved on copper in strong acid (pH<1) with a single pass carbon utilization of 77%, including a conversion toward C2+ products of 50% at 1.2 A/cm$^2$.

With preference, the catholyte has a K+ concentration between 0.5 M and 4 M, or between 0.5 M and 3 M, preferably between 1 M and 2.5 M.

For example, in the cathode, the metal-based catalyst material and the cation-augmenting material are co-deposited as an active layer onto the substrate.

For example, in the cathode, the metal-based catalyst material is deposited as a catalyst layer onto the substrate, and the cation-augmenting material is deposited as a cation-augmenting layer onto the catalyst layer.

For example, in the cathode, the metal-based catalyst layer has a thickness of 300 nm as determined by scanning electron microscopy.

For example, in the cathode, the cation-augmenting layer has a thickness between 1.5 μm and 2 μm as determined by scanning electron microscopy.

For example, in the cathode, the metal-based catalyst material comprises or consists of copper and/or silver.

For example, in the cathode, the metal-based catalyst material is provided as a high-surface area material.

For example, in the cathode, the metal-based catalyst material is provided as nanoparticles.

For example, in the cathode, the cation-augmenting material comprises or consists of a cationic ionomer.

For example, in the cathode, the acidic group is —$SO_3H$.

For example, in the cathode, the cation-augmenting material comprises a cationic perfluorosulfonic acid (PFSA) ionomer.

For example, in the cathode, the PFSA ionomer is composed of tetrafluoroethylene and sulfonyl fluoride vinyl ether.

For example, in the cathode, the cation-augmenting material further comprises carbon nanoparticles or graphite.

For example, in the cathode, the substrate is polytetrafluoroethylene (PTFE) that is configured for gas diffusion.

For example, the gas component further comprises $N_2$.

For example, the catholyte is an acidic catholyte. With preference, the acidic catholyte has a bulk pH between 1 and 4 or the acidic catholyte has a bulk pH of at most 1.

For example, the acidic catholyte comprises at least one of phosphoric acid, sulfuric acid, and perchloric acid.

For example, the cation species further comprise caesium and/or sodium ions.

For example, the catholyte has a total concentration in phosphorous species is ranging between 0.8 M and 1.2 M.

For example, the electrolytic system further comprises a power source providing electric current at an applied current density between 100 $mA \cdot cm^2$ and 1.5 $A \cdot cm^2$.

For example, the electrolytic system further comprises a mass flow controller that is operatively connected to the reactant inlet to adjust an inlet gas flowrate. With preference, the inlet gas flowrate is between 1 and 50 sccm; more preferably, the inlet gas flowrate is between 3 and 10 sccm For example, the electrolytic system further comprises a first peristaltic pump operatively connected to a first tube in fluid communication with the anolyte chamber to circulate the anolyte therein, and a second peristaltic pump operatively connected to a second tube in fluid communication with the catholyte chamber to circulate the catholyte therein. With preference, the catholyte and anolyte are circulated at a constant flowrate.

For example, the CEM is a membrane of perfluorinated sulfonic acid ionomer. With preference, the perfluorinated sulfonic acid ionomer comprises Nafion™ (commercial name of perfluoro(2-(2-sulfonylethoxy)propyl vinyl ether)-tetrafluoroethylene copolymer).

For example, the electrolytic system further comprises a counter electrode being provided in the anolyte chamber. With preference, the counter electrode comprising noble metals such as Pt, Ru, or Ir.

For example, the electrolytic system comprises a reference electrode being provided in the catholyte chamber. With preference, the reference electrode is an Ag/AgCl, $Hg/HgSO_4$ or SCE reference electrode.

For example, the anolyte pH is equal to or less than the catholyte pH.

For example, the anolyte is of the same nature as the catholyte.

In a second aspect, there is provided a method for enhancing carbon utilization during $CO_2$ electroreduction in an electrolytic system remarkable in that the electrolytic system is according to the first aspect, comprising an acidic catholyte and a cathode in contact with the acidic catholyte, and in that the method comprises increasing a local pH of the catholyte at a surface of the cathode.

For example, increasing the local pH of the catholyte at the surface of the cathode comprises operating the electrolytic system at a current density that results in a consumption rate of local $H_3O^+$ protons at the surface of the cathode being higher than mass transport of bulk $H_3O^+$ protons. In a first alternative, the acidic catholyte is advantageously a strong acid having a pH of at most 1; with preference, the current density is between 200 $mA \cdot cm^2$ and 1.5 $A \cdot cm^2$. In a second alternative, the acidic catholyte is advantageously an acid having a pH between 1 and 4; with preference, the current density is between 100 and 200 $mA \cdot cm^2$.

For example, increasing the local pH of the catholyte at the surface of the cathode comprises creating locally neutral or alkaline conditions; with preference, the local pH at the surface of the cathode is 7.

For example, increasing the local pH of the catholyte at the surface of the cathode comprises creating locally alkaline conditions, wherein the local pH at the surface of the cathode is above 7.

For example, increasing the local pH of the catholyte at the surface of the cathode comprises creating a local pH gradient from alkaline to acidic conditions from the surface of the cathode to a bulk of the catholyte. With preference, the local pH is between 8 and 10 at the surface of the cathode and the local pH is at most 6.5 within a distance of at least 30 μm from the surface of the cathode.

For example, increasing the local pH of the catholyte at the surface of the cathode comprises providing cation species at the surface of the cathode. In a first alternative, the cation species are preferably provided within the catholyte. More particularly, the catholyte comprises a cation donor that liberates the cation species. Even more particularly, the cation species is $K^+$ and the cation donor is at least one of potassium chloride, potassium phosphate monobasic, potassium sulfate, potassium iodide, and potassium hydroxide. Most particularly, the catholyte has a K+ concentration between about 0.5 M and 5 M or between 0.5 M and 3 M. In a second alternative, providing the cation species at the surface of the cathode preferably comprises confining the cation species within a cation-augmenting layer of the cathode. More particularly, the cation-augmenting layer comprises an acidic group, for example —$SO_3H$, exchanging protons with the cation species or the CAL comprises an ion conducting polymer, more preferably the ion conducting polymer is a cationic perfluorosulfonic acid (PFSA) ionomer, for example, the PFSA ionomer is composed of tetrafluoroethylene and sulfonyl fluoride vinyl ether.

For example, the acidic catholyte comprises at least one of phosphoric acid, sulfuric acid, and perchloric acid.

For example, the catholyte comprises between 0.1M and 1M of acid and 0.1M and 3M of cation donor. With preference, the catholyte comprises 1 M $H_3PO_4$ and 3M KCl.

For example, a Faradaic Efficiency (FE) of the $CO_2$ electroreduction toward $C_2H_4$ is of at least 10% at a current density between 300 and 800 $mA/cm^2$; with preference, the FE towards $C_2H_4$ is of 13% at the current density of 400 $mA/cm^2$ and/or the FE toward $C_2H_4$ increases from around 10% with the catholyte of 1 M $K^+$ to 26% with the catholyte of 3 M $K^+$ at the current density of 1.2 $A/cm^2$ and/or an overall $CO_2R$ selectivity is about 61±3% with a total FE towards C2+ products of about 40±2%. With preference, the method comprises feeding gaseous $CO_2$ to the cathode at an inlet flowrate between 1 and 50 sccm; more preferably, the inlet flowrate is between 3 sccm and 10 sccm. For example, the cathode comprises copper and a PFSA ionomer and the catholyte is a strong acid having a pH of at most 1, and in that a single pass carbon utilization is of about 77%, including a conversion toward C2+ products of about 50% at an applied current density of 1.2 $A/cm^2$ for the inlet flowrate of 3 sccm.

In a third aspect, the present disclosure provides a method for manufacturing an electrode being the cathode of the electrolytic system according to the first aspect, remarkable in that the electrode operates a $CO_2R$ reaction in an acidic electrolyte, the method comprising depositing a metal-based catalyst material and a cation-augmenting material onto a substrate.

For example, the metal-based catalyst material comprises or consists of copper, silver, or any alloys thereof.

For example, the metal-based catalyst material is provided as a high-surface area material. With preference, the metal-based catalyst material is provided as nanoparticles.

For example, the cation-augmenting material comprises an acidic group exchanging protons with cation species of the acidic electrolyte so as to increase a concentration of the cation species at a surface of the electrode. With preference, the acidic group is $—SO_3H$.

For example, that the cation-augmenting material comprises or consists of a cationic ionomer. With preference, the cationic ionomer is a cationic perfluorosulfonic acid (PFSA) ionomer. More preferably, the PFSA ionomer is composed of tetrafluoroethylene and sulfonyl fluoride vinyl ether.

For example, the cation-augmenting material further comprises carbon nanoparticles or graphite.

For example, the substrate is polytetrafluoroethylene (PTFE) that is configured for gas diffusion.

For example, the step of depositing the catalyst material and the cation-augmenting material comprises depositing the metal-based catalyst material onto the substrate to form a catalyst layer; and depositing the cation-augmenting material onto the catalyst layer to form a cation-augmenting layer. With preference, the step of depositing the catalyst layer onto the substrate comprises sputtering a metal onto a surface of the substrate in a vacuum environment. More preferably, sputtering the metal is performed at a deposition rate of 1 Å/sec. With preference, the step of depositing the cation-augmenting layer onto the catalyst layer comprises spraying a cation-augmenting solution onto the catalyst layer, and the cation-augmenting solution comprising the cation-augmenting material; more preferably, the cation-augmenting solution further comprises methanol. For example, the catalyst layer has a thickness of 300 nm as determined by scanning electron microscopy. For example, the cation-augmenting layer has a thickness between 1.5 μm and about 2 μm as determined by scanning electron microscopy.

For example, the step of depositing the metal-based catalyst material and the cation-augmenting material comprises combining the metal-based catalyst material and the cation-augmenting material to form a mixture; and depositing the mixture onto the substrate to form an active layer. With preference, the step of combining the metal-based catalyst material and the cation-augmenting material comprises forming a homogeneous dispersion of metal nanoparticles and cationic ionomer. More preferably, the step of depositing the mixture comprises spraying the dispersion onto a surface of the substrate to coat the substrate with the active layer. Even more preferably, the spraying is performed in multiple sequences to form multiple active sub-layers.

For example, the active layer comprises a first sublayer having a thickness between 5 μm and 6 μm as determined by scanning electron microscopy, a second sublayer having a thickness between 1.5 μm and 2 μm as determined by scanning electron microscopy, and a third sublayer having a thickness between 1.5 μm and 2 μm as determined by scanning electron microscopy.

In accordance with a further aspect, there is provided an electrode for $CO_2$ electroreduction in an acidic electrolyte comprising cation species, the electrode comprising: a substrate, a metal-based catalyst material, and a cation-augmenting material; wherein the cation-augmenting material comprises an acidic group exchanging protons with the cation species of the acidic electrolyte so as to increase a concentration of the cation species at a surface of the electrode.

In some implementations, the metal-based catalyst material and the cation-augmenting material are co-deposited as an active layer onto the substrate.

In some implementations, the active layer comprises multiple active sub-layers.

In some implementations, the active layer comprises: a first sublayer having a thickness between about 5 μm and about 6 μm, a second sublayer having a thickness between about 1.5 μm and 2 μm, and a third sublayer having a thickness between about 1.5 μm and about 2 μm.

In some implementations, the metal-based catalyst material is deposited as a catalyst layer onto the substrate, and the cation-augmenting material is deposited as a cation-augmenting layer onto the catalyst layer.

In some implementations, the metal-based catalyst layer has a thickness of about 300 nm.

In some implementations, the cation-augmenting layer has a thickness between about 1.5 μm and about 2 μm.

In some implementations, the metal-based catalyst material comprises or consists of copper and silver.

In some implementations, the metal-based catalyst material is provided as a high-surface area material.

In some implementations, the metal-based catalyst material is provided as nanoparticles.

In some implementations, the cation-augmenting material comprises or consists of a cationic ionomer.

In some implementations, the acidic group is $—SO_3H$.

In some implementations, the cation-augmenting material comprises a cationic perfluorosulfonic acid (PFSA) ionomer.

In some implementations, the PFSA ionomer is composed of tetrafluoroethylene and sulfonyl fluoride vinyl ether.

In some implementations, the cation-augmenting material further comprises carbon nanoparticles or graphite.

In some implementations, the substrate is polytetrafluoroethylene (PTFE) that is configured for gas diffusion.

In accordance with a further aspect, there is provided a method for manufacturing an electrode that operates a $CO_2R$ reaction in an acidic electrolyte, the method comprising depositing a metal-based catalyst material and a cation-augmenting material onto a substrate.

In some implementations, the metal-based catalyst material comprises or consists of copper, silver, or any alloys thereof.

In some implementations, the metal-based catalyst material is provided as a high-surface area material.

In some implementations, the metal-based catalyst material is provided as nanoparticles.

In some implementations, the cation-augmenting material comprises an acidic group exchanging protons with cation species of the acidic electrolyte so as to increase a concentration of the cation species at a surface of the electrode In some implementations, the acidic group is $—SO_3H$.

In some implementations, the cation-augmenting material comprises or consists of a cationic ionomer.

In some implementations, the cationic ionomer is a cationic perfluorosulfonic acid (PFSA) ionomer.

In some implementations, the PFSA ionomer is composed of tetrafluoroethylene and sulfonyl fluoride vinyl ether.

In some implementations, the cation-augmenting material further comprises carbon nanoparticles or graphite.

In some implementations, the substrate is polytetrafluoroethylene (PTFE) that is configured for gas diffusion.

In some implementations, the step of depositing the catalyst material and the cation-augmenting material comprises depositing the metal-based catalyst material onto the substrate to form a catalyst layer; and depositing the cation-augmenting material onto the catalyst layer to form a cation-augmenting layer.

In some implementations, the step of depositing the catalyst layer onto the substrate comprises sputtering a metal onto a surface of the substrate in a vacuum environment.

In some implementations, sputtering the metal is performed at a deposition rate of 1 Å/sec.

In some implementations, the step of depositing the cation-augmenting layer onto the catalyst layer comprises spraying a cation-augmenting solution onto the catalyst layer, and the cation-augmenting solution comprising the cation-augmenting material.

In some implementations, the cation-augmenting solution further comprises methanol.

In some implementations, the catalyst layer has a thickness of about 300 nm.

In some implementations, the cation-augmenting layer has a thickness between about 1.5 μm and about 2 μm.

In some implementations, the step of depositing the metal-based catalyst material and the cation-augmenting material comprises: combining the metal-based catalyst material and the cation-augmenting material to form a mixture; and depositing the mixture onto the substrate to form an active layer.

In some implementations, the step of combining the metal-based catalyst material and the cation-augmenting material comprises forming a homogeneous dispersion of metal nanoparticles and cationic ionomer.

In some implementations, the step of depositing the mixture comprises spraying the dispersion onto a surface of the substrate to coat the substrate with the active layer.

In some implementations, the spraying is performed in multiple sequences to form multiple active sub-layers.

In some implementations, the active layer comprises a first sublayer having a thickness between about 5 μm and about 6 μm, a second sublayer having a thickness between about 1.5 μm and about 2 μm, and a third sublayer having a thickness between about 1.5 μm and about 2 μm.

In accordance with a further aspect, there is provided a use of the electrode as defined above for generating multicarbon products with an enhanced yield when in contact with an acidic catholyte having a bulk pH of at most 4.

In accordance with a further aspect, there is provided an electrolytic system for $CO_2$ electroreduction, the system comprising the electrode as defined above, and an acidic electrolyte for contacting of the electrode.

In some implementations, the acidic electrolyte is an acid having a bulk pH of at most 4.

In accordance with a further aspect, there is provided an electrolytic system for $CO_2$ electroreduction into multicarbon ($C_2^+$) products, the system comprising a cathode being the electrode as defined above, the cathode being provided in a catholyte chamber; an anode being provided in an anolyte chamber; an anolyte being contained in the anolyte chamber for contacting the anode; a catholyte being contained in the catholyte chamber for contacting the cathode; a cationic exchange membrane (CEM); a cathodic inlet in fluid communication with the cathode so as to feed the cathode with a gas component comprising $CO_2$; and, a cathodic outlet in fluid communication the catholyte chamber so as to recover a product mixture comprising multicarbon ($C_2^+$) products.

In some implementations, the gas component further comprises $N_2$.

In some implementations, the catholyte is an acidic catholyte.

In some implementations, the acidic catholyte has a bulk pH between 1 and 4, or of at most 1.

In some implementations, the acidic catholyte comprises at least one of phosphoric acid, sulfuric acid, and perchloric acid.

In some implementations, the cation species comprise potassium, caesium or sodium ions.

In some implementations, the cation species comprise potassium ions K+, and the acidic catholyte further comprises at least one of potassium chloride, potassium phosphate monobasic, potassium sulfate, potassium iodide, and potassium hydroxide.

In some implementations, the catholyte has a K+ concentration between about 0.5 M and 5 M, or between 0.5 M and 4 M, or between 0.5 M and 3 M.

In some implementations, the catholyte has a total concentration in phosphorous species is about 1M.

In some implementations, the system further comprises a power source providing electric current at an applied current density between 100 $mA \cdot cm^2$ and 1.5 $A \cdot cm^2$.

In some implementations, the system further comprises a mass flow controller that is operatively connected to the reactant inlet to adjust an inlet gas flowrate.

In some implementations, the inlet gas flowrate is between 1 and 50 sccm.

In some implementations, the inlet gas flowrate is between about 3 and about 10 sccm.

In some implementations, the system further comprises a first peristaltic pump operatively connected to a first tube in fluid communication with the anolyte chamber to circulate the anolyte therein, and a second peristaltic pump operatively connected to a second tube in fluid communication with the catholyte chamber to circulate the catholyte therein.

In some implementations, the catholyte and anolyte are circulated at a constant flowrate.

In some implementations, the CEM is a Nafion™ membrane.

In some implementations, the system further comprises a counter electrode being provided in the anolyte chamber, the counter electrode comprising noble metals, Pt, Ru, or Ir.

In some implementations, the system further comprises a reference electrode being provided in the catholyte chamber, the reference electrode being an Ag/AgCl, $Hg/HgSO_4$ or SCE reference electrode.

In some implementations, the anolyte pH is equal to or less than the catholyte pH.

In some implementations, the anolyte is of the same nature as the catholyte.

In accordance with a further aspect, there is provided a method for enhancing carbon utilization during $CO_2$ electroreduction in an electrolytic system comprising an acidic catholyte and a cathode in contact with the acidic catholyte, the method comprising increasing a local pH of the catholyte at a surface of the cathode.

In some implementations, increasing the local pH of the catholyte at the surface of the cathode comprises operating the electrolytic system at a current density that results in a consumption rate of local $H_3O^+$ protons at the surface of the cathode being higher than mass transport of bulk $H_3O^+$ protons.

In some implementations, the acidic catholyte is a strong acid having a pH of at most 1.

In some implementations, the current density is between 200 mA·cm$^2$ and 1.5 A·cm$^2$.

In some implementations, the acidic catholyte is an acid having a pH between 1 and 4.

In some implementations, the current density is between 100 and 200 mA·cm$^2$

In some implementations, increasing the local pH of the catholyte at the surface of the cathode comprises creating locally neutral or alkaline conditions.

In some implementations, the local pH at the surface of the cathode is about 7.

In some implementations, increasing the local pH of the catholyte at the surface of the cathode comprises creating locally alkaline conditions.

In some implementations, the local pH at the surface of the cathode is above 7.

In some implementations, increasing the local pH of the catholyte at the surface of the cathode comprises creating a local pH gradient from alkaline to acidic conditions from the surface of the cathode to a bulk of the catholyte.

In some implementations, the local pH is between 8 and 10 at the surface of the cathode and the local pH is at most 6.5 within a distance of at least 30 μm from the surface of the cathode.

In some implementations, increasing the local pH of the catholyte at the surface of the cathode comprises providing cation species at the surface of the cathode.

In some implementations, the cation species are provided within the catholyte.

In some implementations, the catholyte comprises a cation donor that liberates the cation species.

In some implementations, the cation species is $K^+$ and the cation donor is at least one of potassium chloride, potassium phosphate monobasic, potassium sulfate, potassium iodide, and potassium hydroxide.

In some implementations, the catholyte has a K+ concentration between about 0.5 M and 5 M.

In some implementations, providing the cation species at the surface of the cathode comprises confining the cation species within a cation-augmenting layer (CAL) of the cathode.

In some implementations, the CAL comprises an acidic group exchanging protons with the cation species.

In some implementations, the acidic group is —$SO_3H$.

In some implementations, the CAL comprises an ion conducting polymer.

In some implementations, the ion conducting polymer is a cationic perfluorosulfonic acid (PFSA) ionomer.

In some implementations, the PFSA ionomer is composed of tetrafluoroethylene and sulfonyl fluoride vinyl ether.

In some implementations, the acidic catholyte comprises at least one of phosphoric acid, sulfuric acid, and perchloric acid.

In some implementations, the catholyte comprises between 0.1M and 1M of acid and 0.1M and 3M of cation donor.

In some implementations, the catholyte comprises 1 M $H_3PO_4$ and 3M KCl.

In some implementations, the cathode is the electrode as defined above.

In some implementations, a Faradaic Efficiency (FE) of the $CO_2$ electroreduction toward $C_2H_4$ is of at least 10% at a current density between 300 and 800 mA/cm$^2$.

In some implementations, the FE towards $C_2H_4$ is of 13% at the current density of 400 mA/cm$^2$.

In some implementations, the FE toward $C_2H_4$ increases from around 10% with the catholyte of 1 M $K^+$ to 26% with the catholyte of 3 M $K^+$ at the current density of 1.2 A/cm$^2$.

In some implementations, an overall $CO_2R$ selectivity is about 61±3% with a total FE toward $C_2$+ products of about 40±2%.

In some implementations, the method comprises feeding gaseous $CO_2$ to the cathode at an inlet flowrate between 1 and 50 sccm.

In some implementations, the inlet flowrate is between 3 sccm and 10 sccm.

In some implementations, the cathode comprises copper and a PFSA ionomer and the catholyte is a strong acid having a pH of at most 1, and wherein a single pass carbon utilization is of about 77%, including a conversion toward $C_2$+ products of about 50% at an applied current density of 1.2 A/cm$^2$ for the inlet flowrate of 3 sccm.

Various implementations, features and aspects of the present techniques are described herein, including in the claims, figures and following description.

BRIEF DESCRIPTION OF DRAWINGS

The figures describe various aspects and information regarding the techniques described and claimed herein.

DETAILED DESCRIPTION

Figure 1:
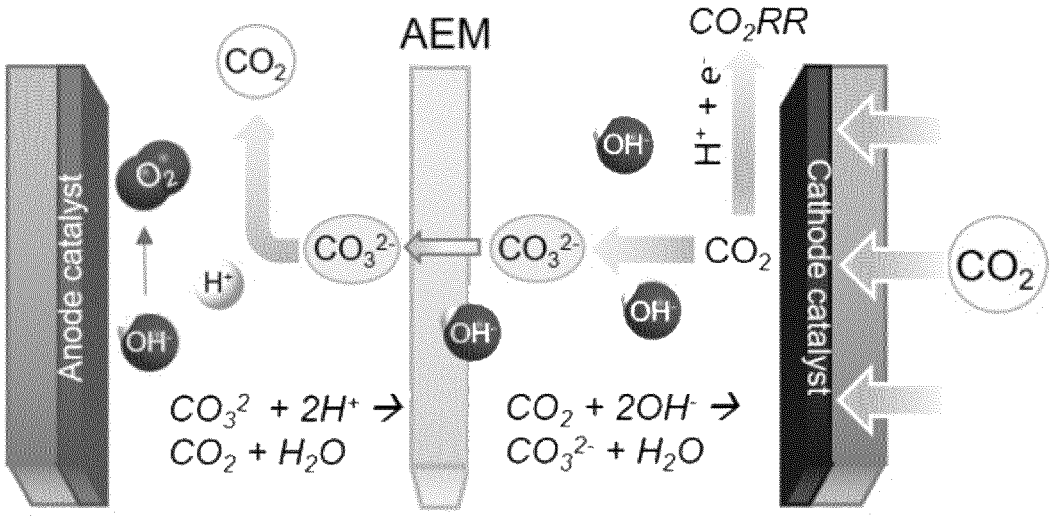
FIG. 1: Acidic $CO_2$ reduction vs. alkaline and neutral $CO_2$ reduction. Schematic of carbonate formation and crossover phenomenon observed in neutral electrolyte-based reactor using anion exchange membrane.

For the disclosure, the following definitions are given:

The terms "comprising", "comprises" and "comprised of" as used herein are synonymous with "including", "includes" or "containing", "contains", and are inclusive or open-ended and do not exclude additional, non-recited members, elements or method steps. The terms "comprising", "comprises" and "comprised of" also include the term "consisting of".

The recitation of numerical ranges by endpoints includes all integer numbers and, where appropriate, fractions subsumed within that range (e.g., 1 to 5 can include 1, 2, 3, 4, 5 when referring to, for example, a number of elements, and can also include 1.5, 2, 2.75 and 3.80, when referring to, for example, measurements). The recitation of endpoints also includes the recited endpoint values themselves (e.g., from 1.0 to 5.0 includes both 1.0 and 5.0). Any numerical range recited herein is intended to include all sub-ranges subsumed therein.

The term "transition metal" refers to an element whose atom has a partially filled d sub-shell, or which can give rise to cations with an incomplete d sub-shell (IUPAC definition). According to this definition, the transition metals are Sc, Ti, V, Cr, Mn, Fe, Co, Ni, Cu, Zn, Y, Zr, Nb, Mo, Tc, Ru, Rh, Pd, Ag, Cd, La, Hf, Ta, W, Re, Os, Ir, Pt, Au, Hg, Ac, Rf, Db, Sg, Bh, Hs, Mt, Ds, Rg, and Cn.

The metals Ga, In, Sn, Tl, Pb and Bi are considered as "post-transition" metals.

The metals Au, Ag, Ru, Rh, Pd, Os, Ir and Pt show outstanding oxidation resistance and are considered "noble" metals. Other metals can be considered as "non-noble" metals.

The term "alkali metal" refers to an element classified as an element from group 1 of the periodic table of elements (or group IA), excluding hydrogen. According to this definition, the alkali metals are Li, Na, K, Rb, Cs and Fr.

The term "alkaline earth metal" refers to an element classified as an element from group 2 of the periodic table of elements (or group IIA). According to this definition, the alkaline earth metals are Be, Mg, Ca, Sr, Ba and Ra.

The term "rare earth elements" refer to the fifteen lanthanides, as well as scandium and yttrium. The 17 rare-earth elements are cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb), and yttrium (Y).

The present disclosure provides an electrolytic system for $CO_2$ electroreduction into multicarbon ($C_2^+$) products, the system comprising:

- a cathode being an electrode for $CO_2$ electroreduction in an acidic electrolyte comprising cation species, the electrode comprising a substrate, a metal-based catalyst material and a cation-augmenting material, the cathode being provided in a catholyte chamber;
- a catholyte being contained in the catholyte chamber for contacting the cathode, said catholyte being an acidic catholyte comprising cation species
  - wherein the cation-augmenting material comprises an acid group exchanging protons with the cation species of the acid electrolyte so as to increase a concentration of the cation species at the surface of the electrode;
- an anode being provided in an anolyte chamber;
- an anolyte being contained in the anolyte chamber for contacting the anode;
- a cationic exchange membrane;
- a cathodic inlet in fluid communication with the cathode so as to feed the cathode with a gas component comprising $CO_2$; and
- a cathodic outlet in fluid communication the catholyte chamber so as to recover a product mixture comprising multicarbon ($C_2^+$) products;

the system being remarkable in that the cation species comprises one or more alkali metal ions, said alkali metal of said one or more alkali metal ions being selected from potassium, caesium or sodium, and the acidic catholyte further comprises at least one of chloride, phosphate monobasic, sulfate, iodide, and hydroxide of the selected alkali metal ions, and in that the catholyte has an alkali metal ion concentration between 0.5 M and 5 M, or between 0.5 M and 3 M.

With preference, the catholyte has an alkali metal ion concentration between 0.5 M and 4 M, or between 0.5 M and 3 M, preferably between 1 M and 2.5 M.

In particular, the present disclosure relates to the disclosure provides an electrolytic system for $CO_2$ electroreduction into multicarbon ($C_2^+$) products, the system comprising:

- a cathode being an electrode for $CO_2$ electroreduction in an acidic electrolyte comprising cation species, the electrode comprising a substrate, a metal-based catalyst material and a cation-augmenting material, the cathode being provided in a catholyte chamber;
- a catholyte being contained in the catholyte chamber for contacting the cathode, said catholyte being an acidic catholyte comprising cation species
  - wherein the cation-augmenting material comprises an acid group exchanging protons with the cation species of the acid electrolyte so as to increase a concentration of the cation species at the surface of the electrode;
- an anode being provided in an anolyte chamber;
- an anolyte being contained in the anolyte chamber for contacting the anode;
- a cationic exchange membrane;
- a cathodic inlet in fluid communication with the cathode so as to feed the cathode with a gas component comprising $CO_2$; and
- a cathodic outlet in fluid communication the catholyte chamber so as to recover a product mixture comprising multicarbon ($C_2^+$) products;

the system being remarkable in that the cation species comprise potassium ions K+, and the acidic catholyte further comprises at least one of potassium chloride, potassium phosphate monobasic, potassium sulfate, potassium iodide, and potassium hydroxide, and in that the catholyte has a K+ concentration between 0.5 M and 5 M, or between 0.5 M and 3 M.

Figure 4:
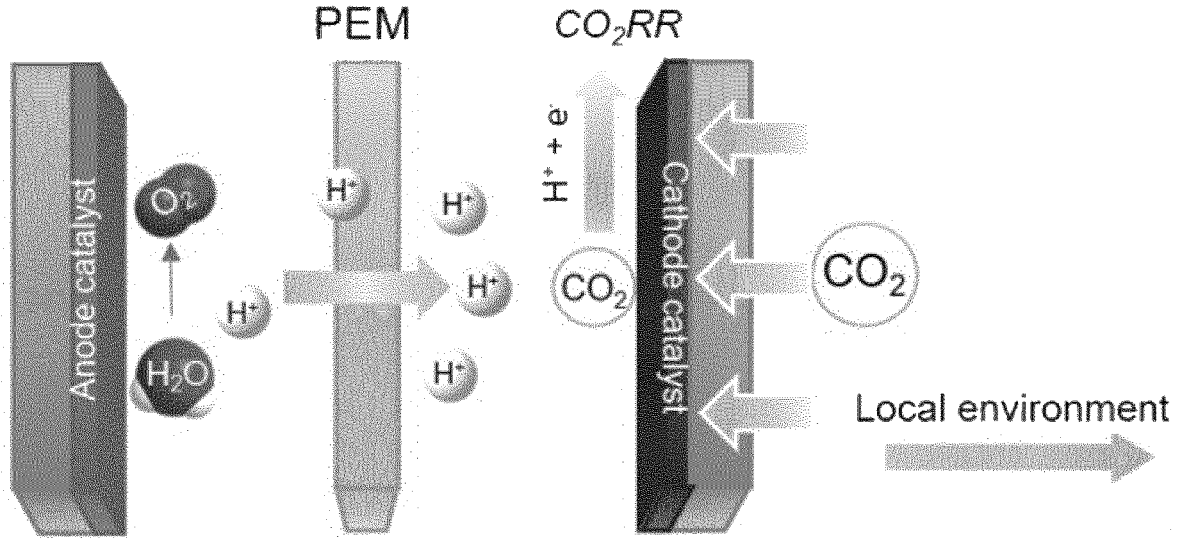
FIG. 4: Acidic $CO_2$ reduction vs. alkaline and neutral $CO_2$ reduction. Schematic of ion transport in acidic $CO_2R$ reactors.
Figure 5:
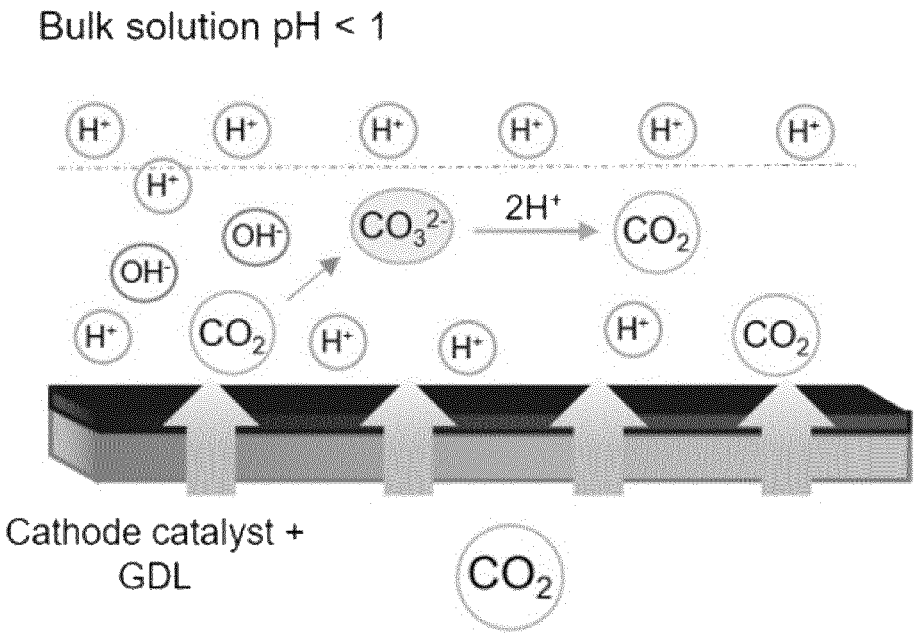
FIG. 5: Acidic $CO_2$ reduction vs. alkaline and neutral $CO_2$ reduction. Schematic of reactions in acidic $CO_2R$ reactors.
Figure 6:
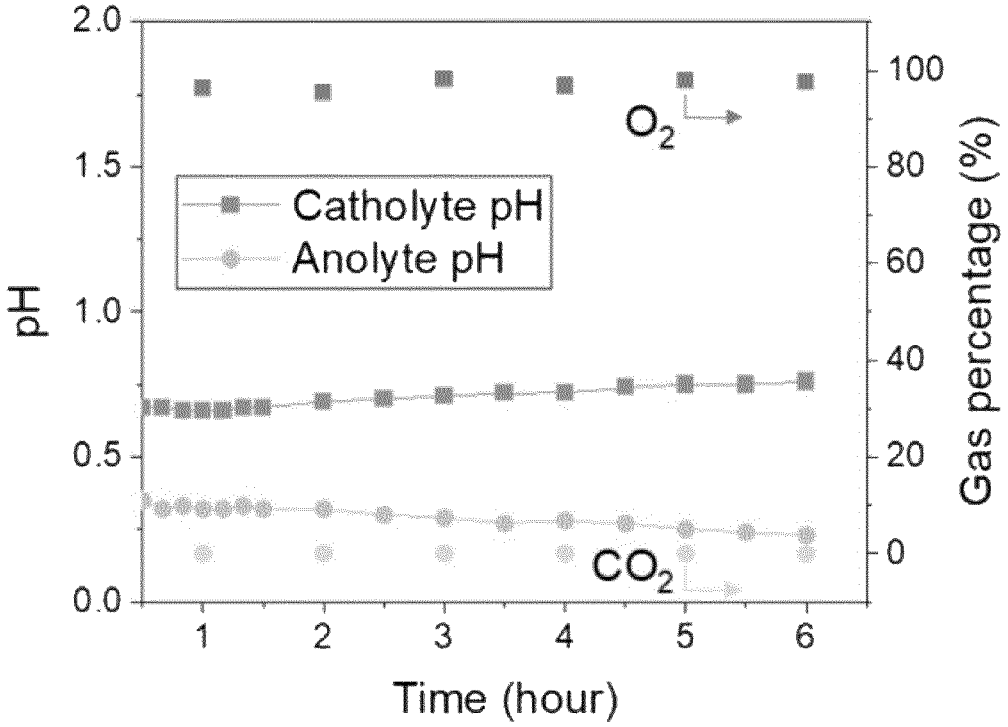
FIG. 6: Acidic $CO_2$ reduction vs. alkaline and neutral $CO_2$ reduction. Product analysis of the outlet gases at the anode side and monitor of pH of catholyte and anolyte in a flow cell consisted of 1 M $H_3PO_4$ and 3 M KCl as the catholyte, 0.5 M $H_2SO_4$ as the anolyte, and Nafion™ as the membrane. The cell was operated at a constant current density of 400 mA/cm$^2$.
Figure 7:
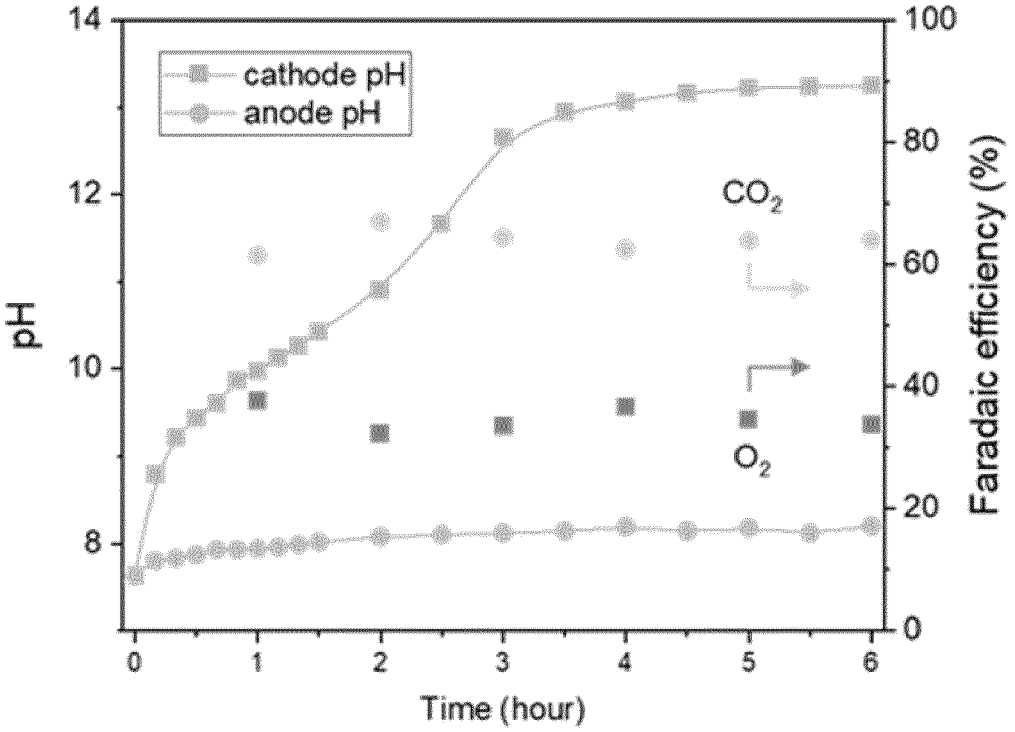
FIG. 7: $CO_2$ crossover tests in different electrolytes at a constant current density of 400 mA/cm$^2$. 1 M $KHCO_3$ with AEM. Large amount of $CO_2$ crossover was observed in neutral media flow cell using 1 M $KHCO_3$ as both anolyte and catholyte. The gas exiting from the anode outlet has a composition of $CO_2$:$O_2$ around 7:3.
Figure 8:
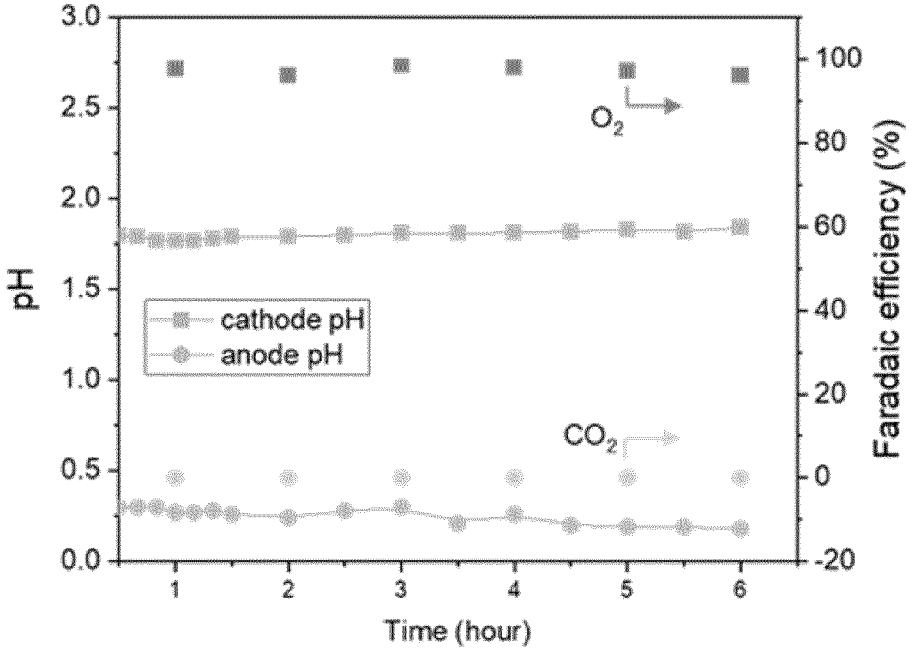
FIG. 8: $CO_2$ crossover tests in different electrolytes at a constant current density of 400 mA/cm$^2$. 0.5 M $H_3PO_4$+0.5 M $KH_2PO_4$ catholyte and 0.5 M $H_2SO_4$ anolyte with cation exchange membrane (CEM).
Figure 9:
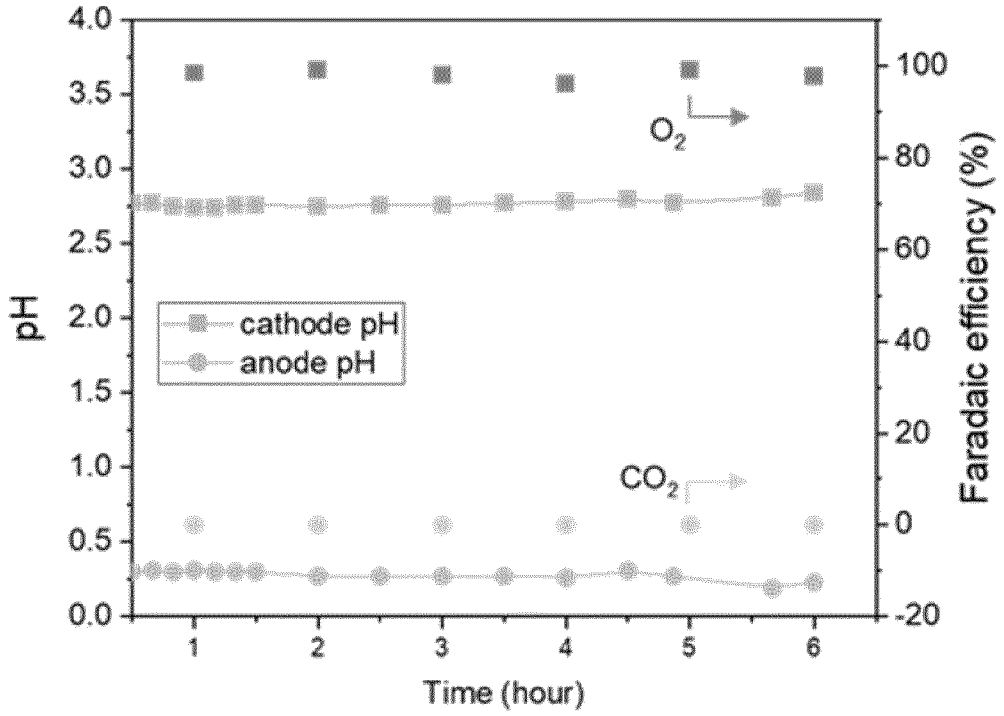
FIG. 9: $CO_2$ crossover tests in different electrolytes at a constant current density of 400 mA/cm$^2$. 0.1 M $H_3PO_4$+0.9 M $KH_2PO_4$ catholyte and 0.5 M $H_2SO_4$ anolyte with CEM.
Figure 10:
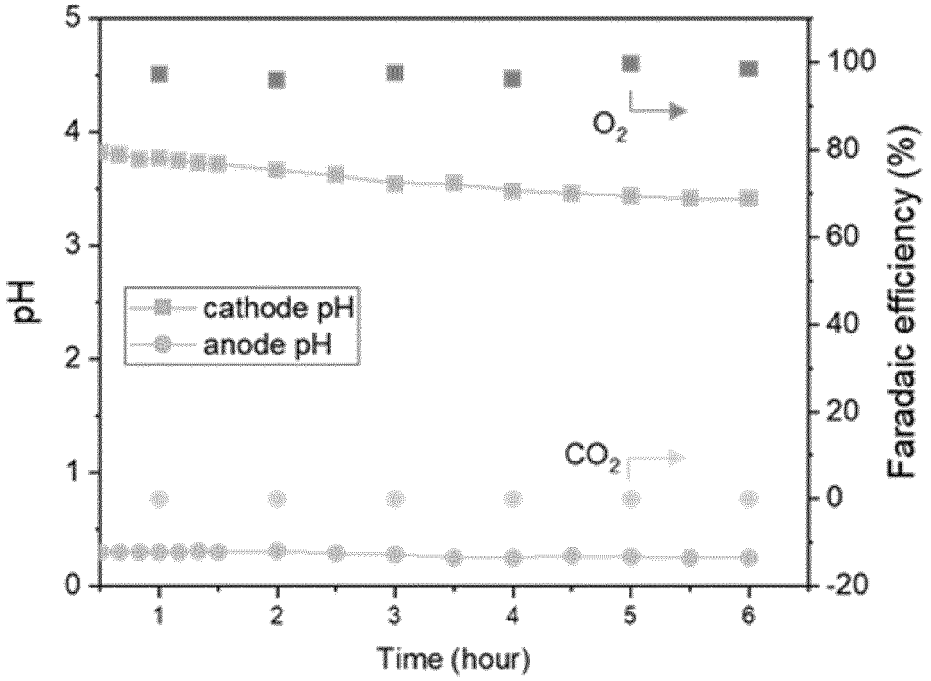
FIG. 10: $CO_2$ crossover tests in different electrolytes at a constant current density of 400 mA/cm$^2$. 1 M $KH_2PO_4$ catholyte and 0.5 M $H_2SO_4$ anolyte with CEM.

$CO_2R$ in acidic media offers an avenue to reduce carbonate formation to near-zero, and thus also eliminate $CO_2$ crossover (FIGS. 4 and 5). Specifically, when $H_3O^+$ is the proton source for $CO_2R$, no $OH^-$ is generated and $CO_2$ conversion can proceed without carbonate formation; when $H_2O$ being the proton source, any carbonate generated locally will lie within the diffusion layer and be converted back to $CO_2$ by protons in bulk electrolyte (19). Initial test using phosphate electrolytes (pH 1-4) showed no measurable loss of $CO_2$ to the anode at 400 mA/cm$^2$ over 6 hours (FIG. 6) compared to a loss of ~70% of input $CO_2$ in the reference case with bicarbonate electrolyte (FIGS. 7 to 10). However, under acidic conditions, the reduction of $CO_2$ can be outcompeted by the kinetically more favorable hydrogen evolution reaction (HER, $2H^+ + 2e^- \rightarrow H_2$), with $CO_2R$ FE close to zero in strong acids (pH<1). These results are in agreement with past work on $CO_2R$ operating in electrolytes of pH 2-5, with limited carbon products detected (mostly CO and formic acid with trace methane), and only at low current density (<10 mA/cm$^2$) (19-25).

Figure 11:
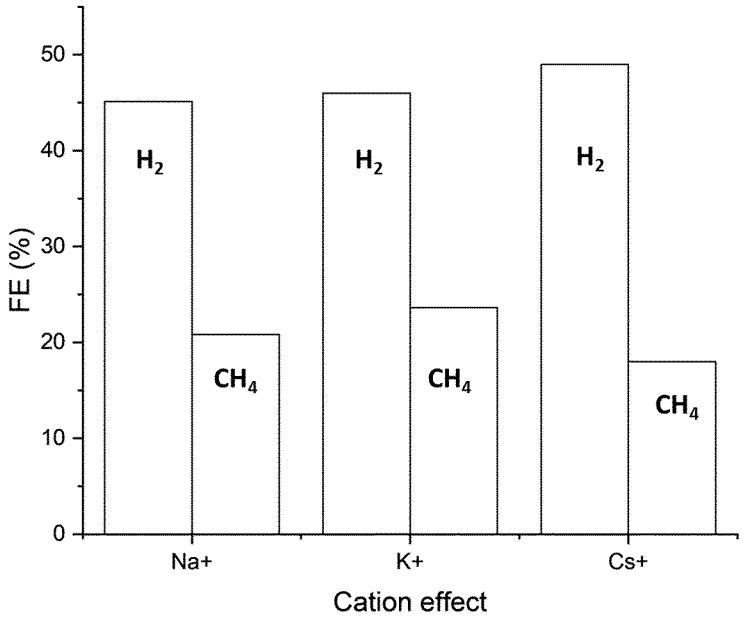
FIG. 11: Influence of three alkali cations ($K^+$, $Cs^+$ and $Na^+$) on the $CO_2$ reduction in acidic electrolyte.
Figure 12:
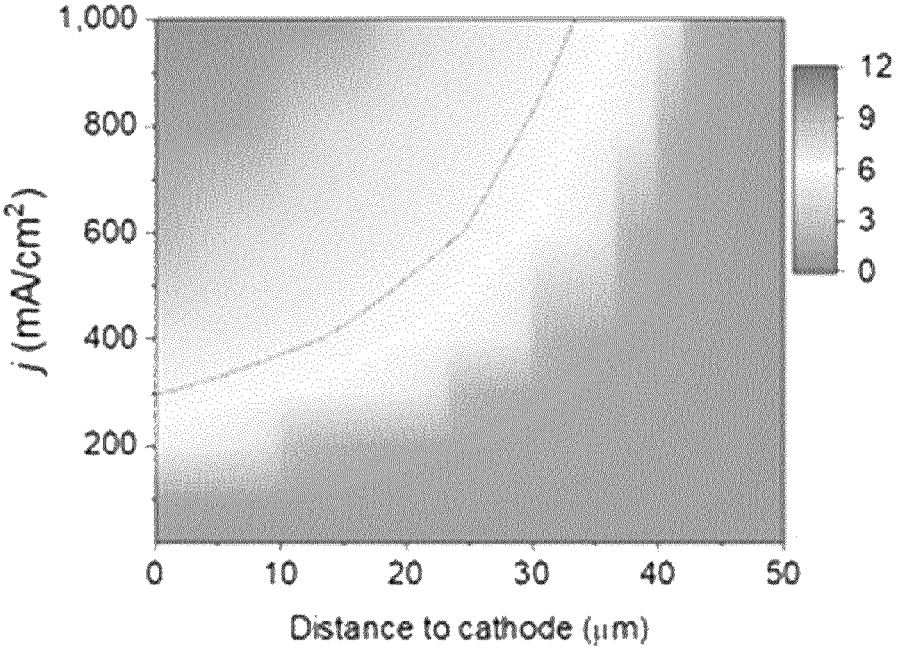
FIG. 12: Cation enables $CO_2$ reduction in acidic electrolyte. Modelling of pH at different distance to cathode and current density in 1 M $H_3PO_4$ and 3 M KCl. The pH was adjusted to 1 by KOH

There is provided herein a strategy to enhance carbon utilization by increasing a concentration of cation species at a surface of the electrode, so as to improve $CO_2$ activation kinetics when the electrolyte is an acid, such as a strong acid (pH<1). This strategy can be referred to herein as a cation-augmenting strategy. Potassium ions are the cation species that have been tested herein. However, various cation species can be confined at the surface of the electrode, such as caesium and/or sodium as shown on FIG. 11. Indeed, caesium and/or sodium have also been proven to be effective in suppressing the hydrogen evolution reaction and improving the $CO_2$ electroreduction.

The Faradaic Efficiency (FE) of the $CO_2$ electroreduction toward $C_2H_4$ in presence of potassium ions is of at least 10% at a current density between 300 and 800 mA/cm$^2$. The FE towards $C_2H_4$ in presence of potassium ions is of 13% at the current density of 400 mA/cm$^2$.

The FE of the $CO_2$ electroreduction toward $C_2H_4$ in presence of Cs+ is 6% at the current density of 400 mA/cm$^2$.

The FE of the $CO_2$ electroreduction toward $C_2H_4$ in presence of Na+ is 12% at the current density of 400 mA/cm$^2$.

The overall $CO_2R$ selectivity, measured at a current density of 1.2 A/cm$^2$, in presence of potassium ions is 61±3% with a total FE towards C2+ products of 40±2%.

The overall $CO_2R$ selectivity, measured at a current density of 1.2 A/cm$^2$, in presence of Cs+ is 56% with a total FE towards C2+ products of 36%.

The overall $CO_2R$ selectivity, measured at a current density of 1.2 A/cm$^2$, in presence of Na+ is 55% with a total FE towards C2+ products of 30%.

The strategy—when applied on a high-surface-area copper (Cu) catalyst—can enable a single pass carbon efficiency (SPCE) of about 77%, thereby exceeding the theoretical limit in neutral and alkaline media. For example, the $CO_2R$ reaction can be operated to convert 50% of input $CO_2$ to multicarbon ($C_{2+}$) products at an applied current density of 1.2 A/cm$^2$.

It should be noted that the local pH refers herein to a pH that varies according to a gradient within a 50 μm distance from the cathode surface, whereas the bulk pH refers to the pH of the bulk electrolyte. The local pH at the surface of the electrode (distance to electrode=0) can be referred to a surface pH. The electrode where $CO_2R$ is performed in the cathode, so the local pH variation can be found in the catholyte side of the system. Thus, the electrolyte can refer herein to the catholyte being an acid of pH of at most 4. For example, a high-concentration phosphate (total phosphorous species can be kept to between 0.8 M and 1.2 M, or to between 0.9 M and 1.1 M, for example to 1 M) can be used as electrolyte to keep a local pH at the cathode as close as possible to a bulk pH (26) of the electrolyte. In addition, the anolyte is selected to include enough protons to sustain the current density, and thus can have a pH at least equal to or less than the bulk pH of the catholyte. For example, the anolyte can be chosen to be the same as the catholyte.

Modelling of reaction and diffusion of species within a typical diffusion layer of 50 μm showed that, in a phosphoric acid (1 M, pH 1.05) electrolyte, the surface (distance to cathode=0) pH is similar to the bulk pH at current densities <200 mA/cm$^2$ while becoming neutral and alkaline when current densities are further increased (FIGS. 12 to 15; tables 3, 4 and 5).

TABLE 3

Sechenov's Constant values.
(See study of S. Weisenberger et al., entitled "*Estimation of gas solubilities in salt solutions at temperatures from 273 K to 363 K*". AIChE J. 42, 298-300 (1996).

| Constant | Value |
|---|---|
| $h_{G,0}$ | −0.0172 |
| $h_T$ | −0.000338 |
| $h_K$ | 0.0922 |
| $h_{Cl}$ | 0.0318 |
| $h_{OH}$ | 0.0839 |
| $h_{HCO3}$ | 0.0967 |
| $h_{CO3}$ | 0.1423 |
| $h_{H2PO4}$ | 0.0906 |
| $h_{HPO4}$ | 0.1499 |
| $h_{PO4}$ | 0.2119 |

TABLE 4

Diffusion coefficient values.

| Diffusion coefficient | Value (1e−9 $m^2/s$) |
|---|---|
| $CO_2$ | 1.91 |
| $CO_3^{2-}$ | 0.923 |
| $HCO_3^-$ | 1.185 |
| $H^+$ | 9.31 |
| $OH^-$ | 5.273 |
| $H_3PO_4$ | 0.918 |
| $H_2PO_4^-$ | 0.918 |
| $HPO_4^{2-}$ | 0.458 |
| $PO_4^{3-}$ | 0.612 |

TABLE 5

The assumed product distribution in the modeling.

| Product | $H_2$ | CO + HCOOH | $CH_4$ | $C_2H_4$ + $C_2H_5OH$ | Total FE |
|---|---|---|---|---|---|
| FE (%) | S | X | Y | Z | X + Y + Z + S |

Figure 13:
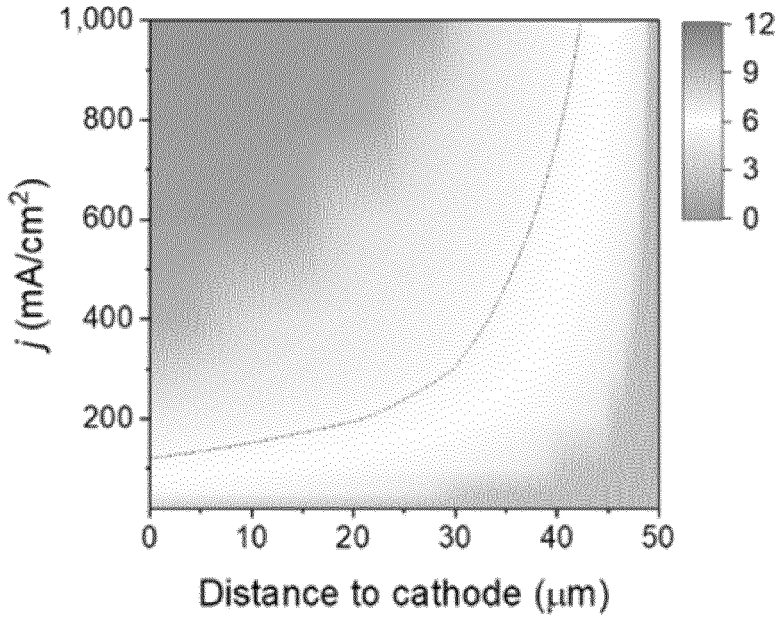
FIG. 13: Modelling of pH near the cathode for 1 M phosphate catholyte of a bulk pH. of 1.94.
Figure 14:
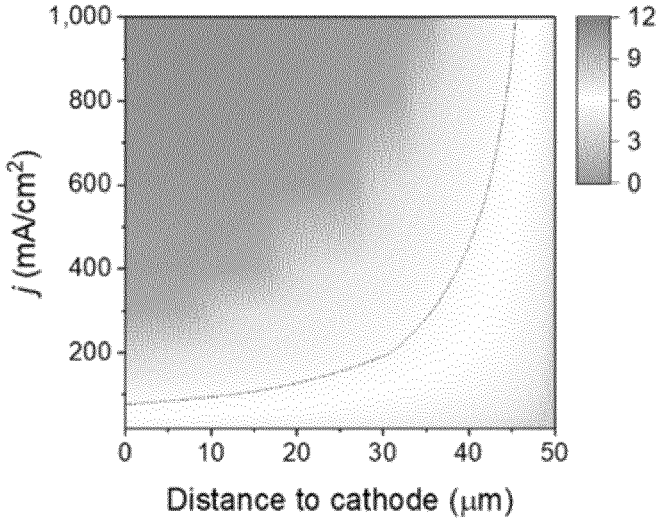
FIG. 14: Modelling of pH near the cathode for 1 M phosphate catholyte of a bulk pH. of 3.02.
Figure 15:
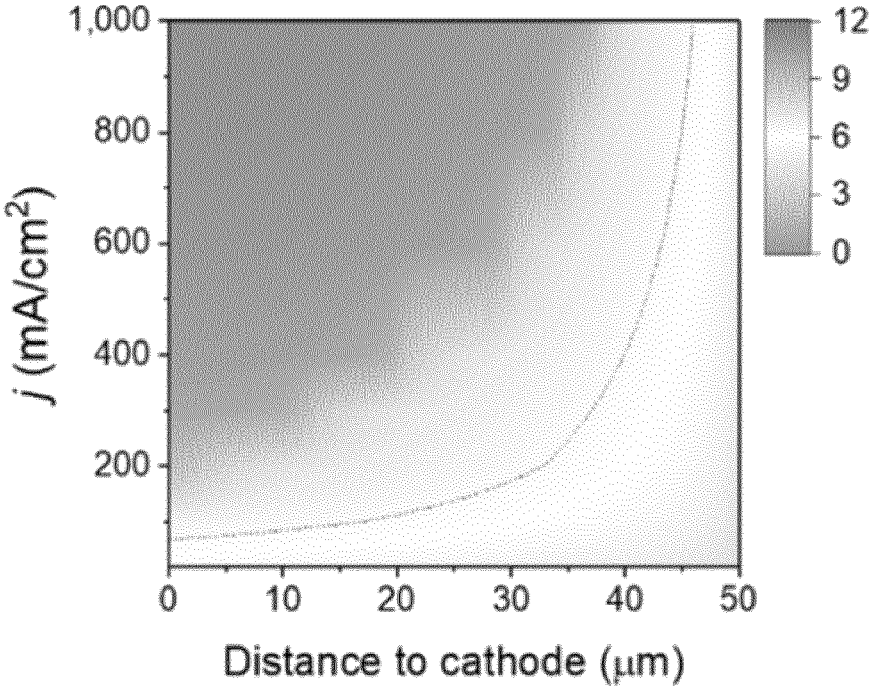
FIG. 15: Modelling of pH near the cathode for 1 M phosphate catholyte of a bulk pH. of 3.96.

The locally alkaline conditions result from a consumption rate of local protons that exceeds mass transport of protons from bulk (27). Despite elevated pH at the surface of the cathode, pH decreases to acidic range within a short distance to the cathode. Even at a current density as high as 1 A/$cm^2$, the local pH decreases to 6.3 ($pKa_1$ of carbonic acid) within 33 μm of the electrode. This confinement assures that any locally generated carbonate would be converted back to $CO_2$ for ensuing reduction, avoiding carbonate crossover and the associated loss of reactant $CO_2$. In comparison, similar conditions (local pH 6.3 at a distance to the cathode of 30 μm) are reached at much lower current densities (<200 mA/$cm^2$) in electrolytes of pH 2-4 (FIGS. 13 to 15). In the interest of realizing economic $CO_2$ electrolyzers (28), high-rate $CO_2$ electrolysis can be performed in strong acid (bulk pH ≤1).

Figure 16:
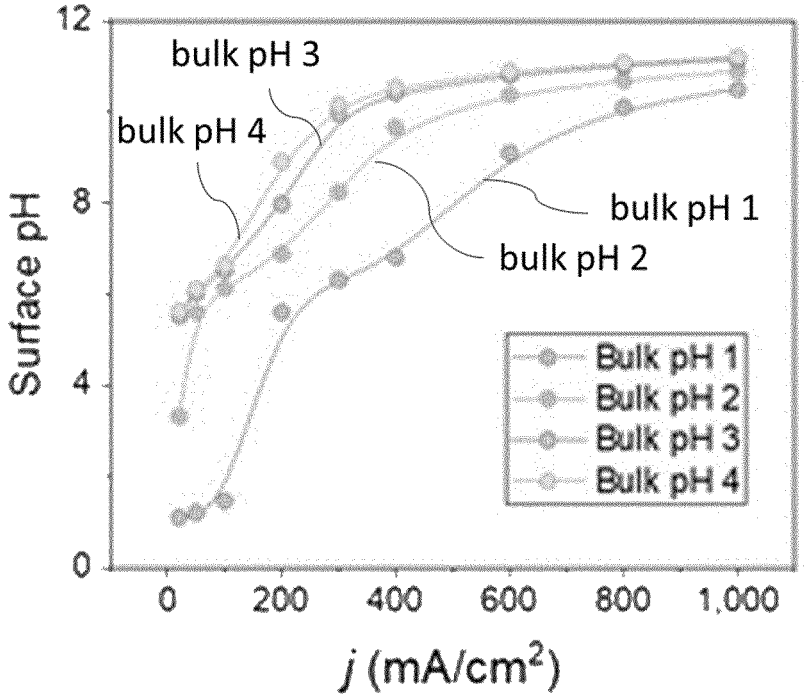
FIG. 16: Cation enables $CO_2$ reduction in acidic electrolyte. Surface (distance to cathode=0) pH at various bulk catholyte pH and applied current densities j.
Figure 17:
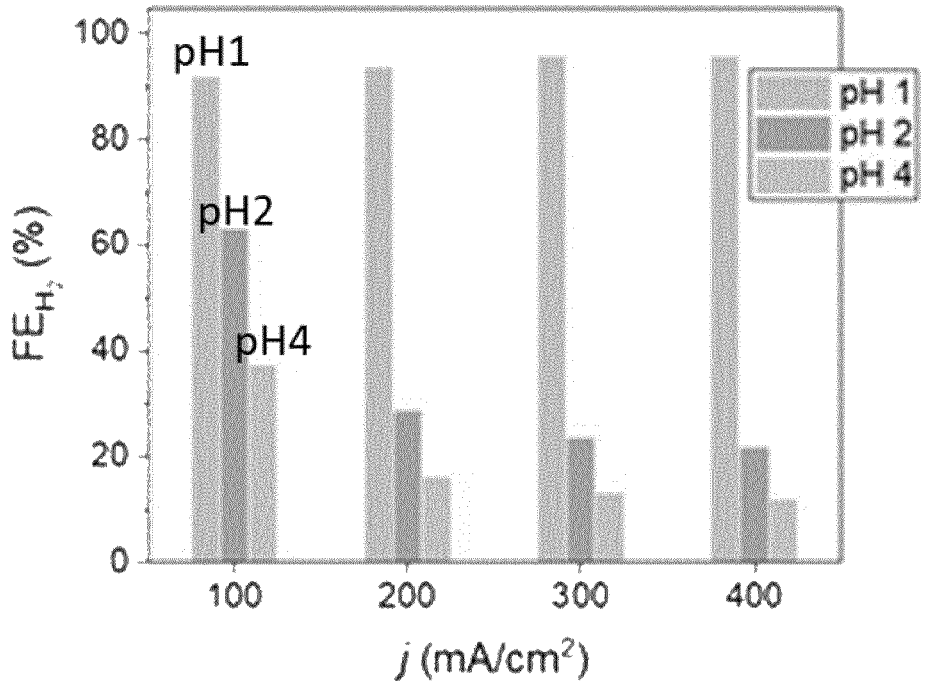
FIG. 17: Cation enables $CO_2$ reduction in acidic electrolyte. FE toward hydrogen at current density of 100-400 mA/cm$^2$ in phosphate electrolytes with different bulk pH from 1 to 4.
Figure 18:
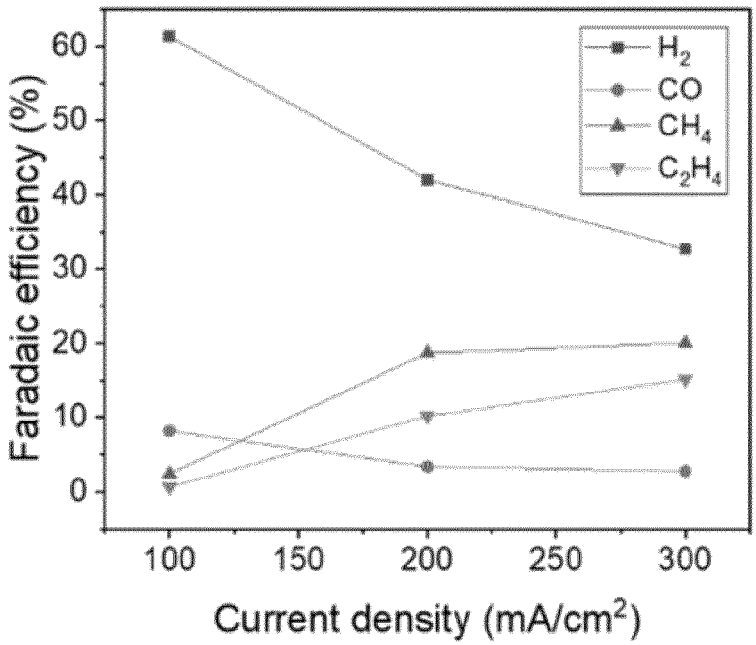
FIG. 18: Faradaic efficiency of sputtered Cu under 100 mA/cm$^2$ to 300 mA/cm$^2$ in 1 M phosphate electrolyte (catholyte and anolyte) of a bulk pH of 2.
Figure 19:
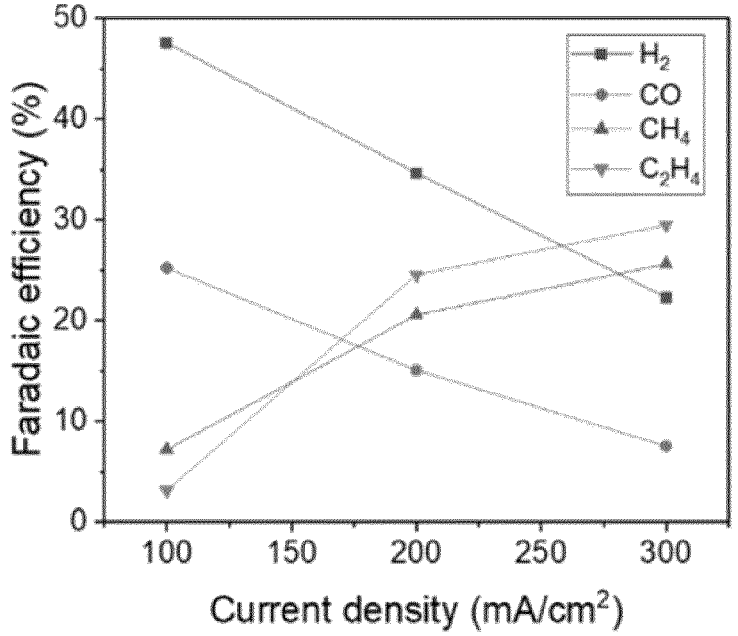
FIG. 19: Faradaic efficiency of sputtered Cu under 100 mA/cm$^2$ to 300 mA/cm$^2$ in 1 M phosphate electrolyte (catholyte and anolyte) of a bulk pH of 3.
Figure 20:
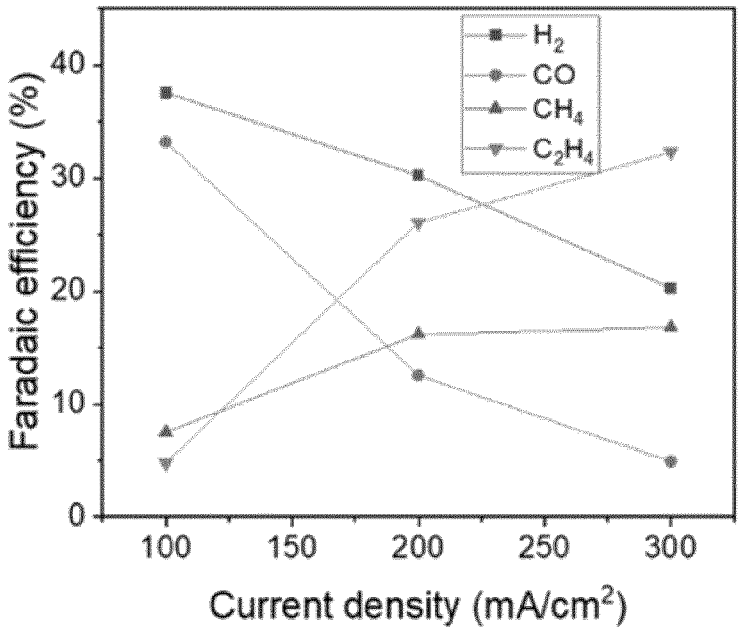
FIG. 20: Faradaic efficiency of sputtered Cu under 100 mA/cm$^2$ to 300 mA/cm$^2$ in 1 M phosphate electrolyte (catholyte and anolyte) of a bulk pH of 4.

One operating parameter that can be controlled when adjusting the local pH at the surface of the cathode is the applied current density. To circumvent the kinetically more favourable HER in acid, $CO_2R$ was tested at current densities where the $H_3O^+$ mass-transport limitation occurs and $H_2O$ becomes the main proton donor at the cathode surface (19, 22). Modelling shows that the surface pH approaches neutrality when the current density reaches 100 mA/$cm^2$ for electrolytes with pH 2-4 or above 200 mA/$cm^2$ for electrolyte with pH 1 (FIG. 16). Indeed, marked decrease of HER selectivity was observed in electrolytes with pH 2 and 4 at current density range of 100-400 mA/$cm^2$; however, no measurable $CO_2R$ products were detected in electrolyte with pH 1, even if the current density were 400 mA/$cm^2$ (FIGS. 17 to 20), at which the surface pH was modelled to be 7.

Figure 21:
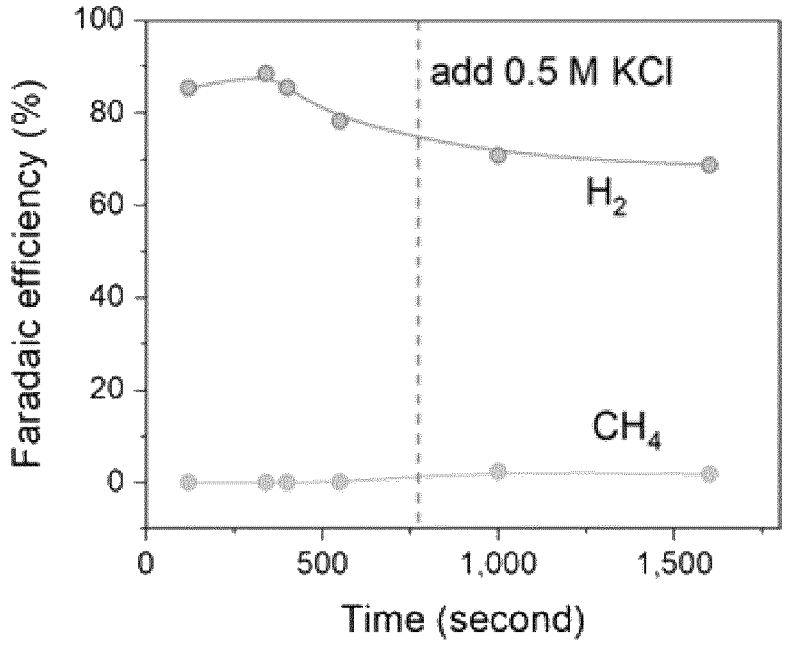
FIG. 21: Effect of KCl addition on the Faradaic efficiency of $CH_4$ and $H_2$ at 200 mA/cm$^2$. When 0.5 M KCl was added into 1 M $H_3PO_4$, a decrease in hydrogen evolution reaction (HER) activity and a slight $CO_2$RR activity towards $CH_4$ were observed.

Another operating parameter that can be controlled when adjusting the local pH at the surface of the cathode is a concentration of the cation species at the surface of the electrode or proximal to this surface. The concentration of the cation species can be maintained higher proximal or at the surface of the electrode so as to establish local alkaline conditions that prevent domination of the HER over the $CO_2R$. The term "proximal" used in relation to the surface of the electrode should be understood as within a distance of at most 30 μm, at most 20 μm or at most 10 μm from the surface of the electrode. When 0.5 M KCl was added into the phosphoric acid electrolyte (pH 1) in the middle of the reaction, a slight decrease in FE toward hydrogen was observed, and $CH_4$ (FE 2.1±0.3%) was detected at a current density of 200 mA/$cm^2$ (FIG. 21). Noting that the phosphate electrolytes with different pH were prepared by mixing $H_3PO_4$ and $KH_2PO_4$ at different ratios, ion species, particularly cations (29-31), appear to steer kinetics of catalysis at bulk pH<1.

Figure 22:
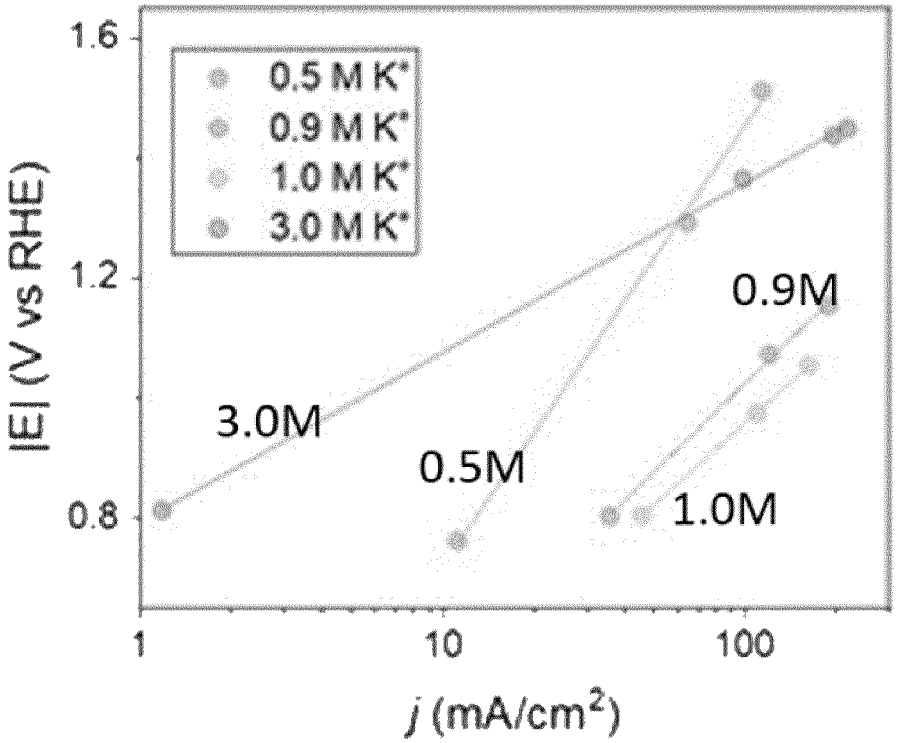
FIG. 22: Cation enables $CO_2$ reduction in acidic electrolyte. Tafel slopes obtained in electrolyte with different $K^+$ concentrations. The absolute value of applied potential (after iR compensation) is used instead of overpotential since the overpotential for different $CO_2$ reduction products is not the same.
Figure 23:
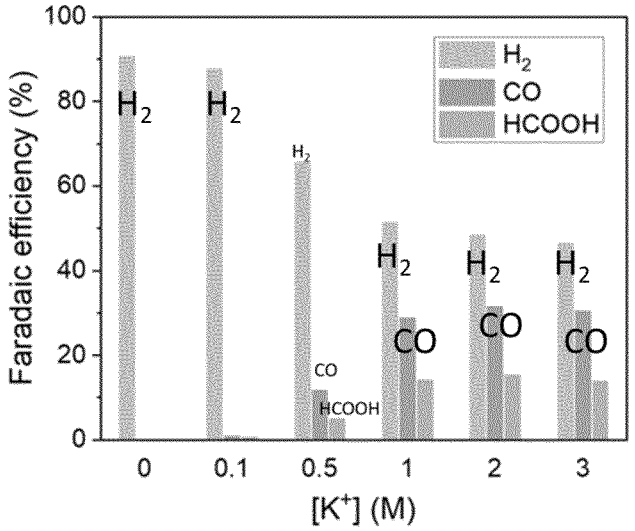
FIG. 23: Faradaic efficiency of sputtered Ag with different KCl concentrations at 400 mA/cm$^2$.
Figure 24:
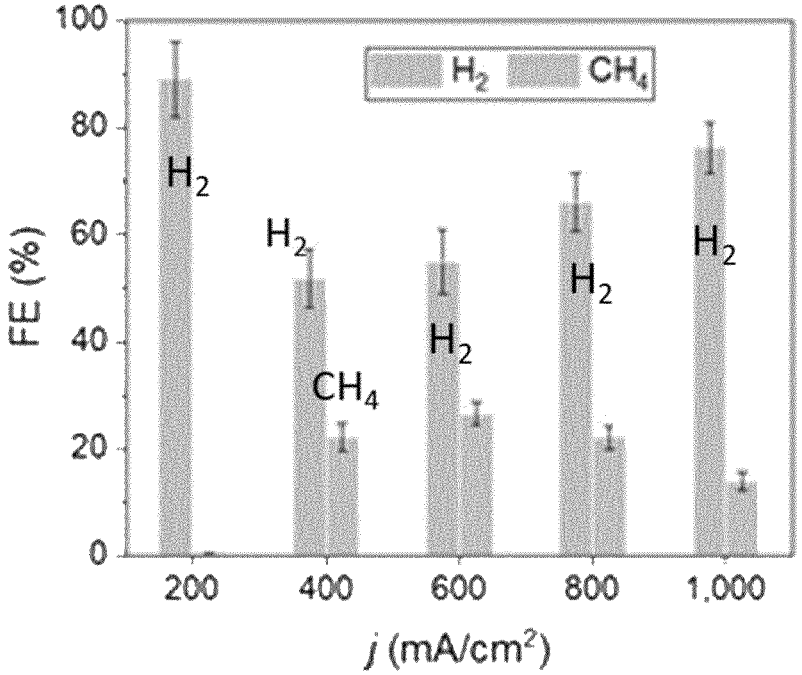
FIG. 24: Cation enables $CO_2$ reduction in acidic electrolyte. FE toward $H_2$ and $CH_4$ of sputtered Cu catalyst at different current densities in 1 M $H_3PO_4$ and 3 M KCl.
Figure 25:
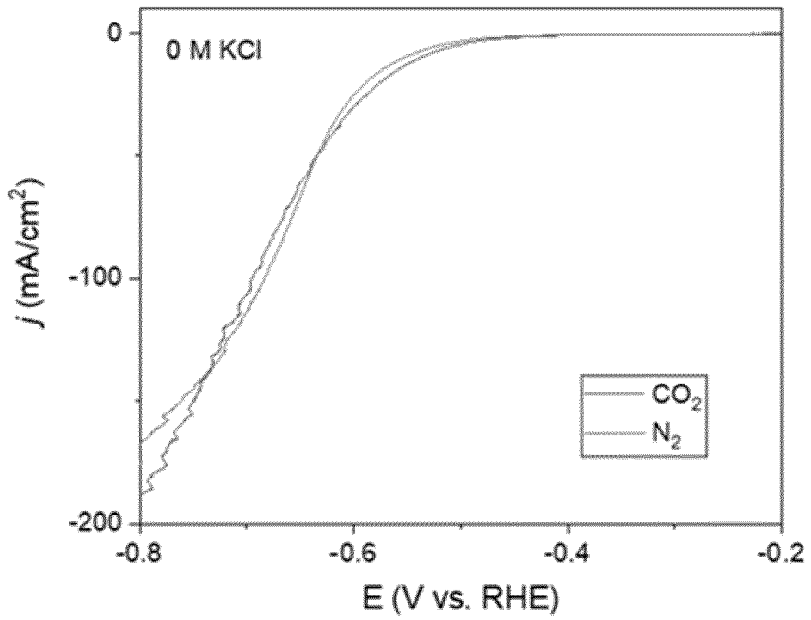
FIG. 25: The effect of no KCl addition to the 1 M $H_3PO_4$ on hydrogen evolution activity.
Figure 26:
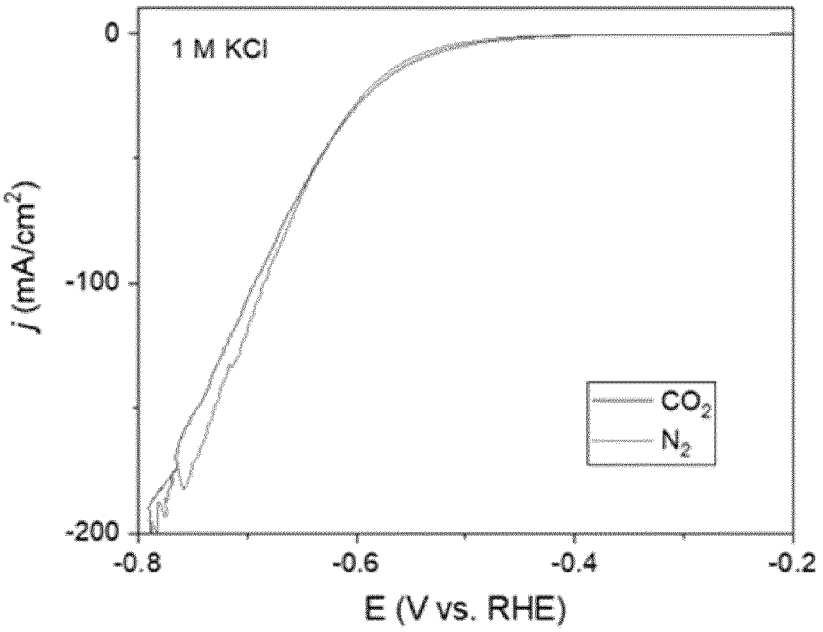
FIG. 26: The effect of 1M KCl addition to the 1 M $H_3PO_4$ on hydrogen evolution activity.
Figure 27:
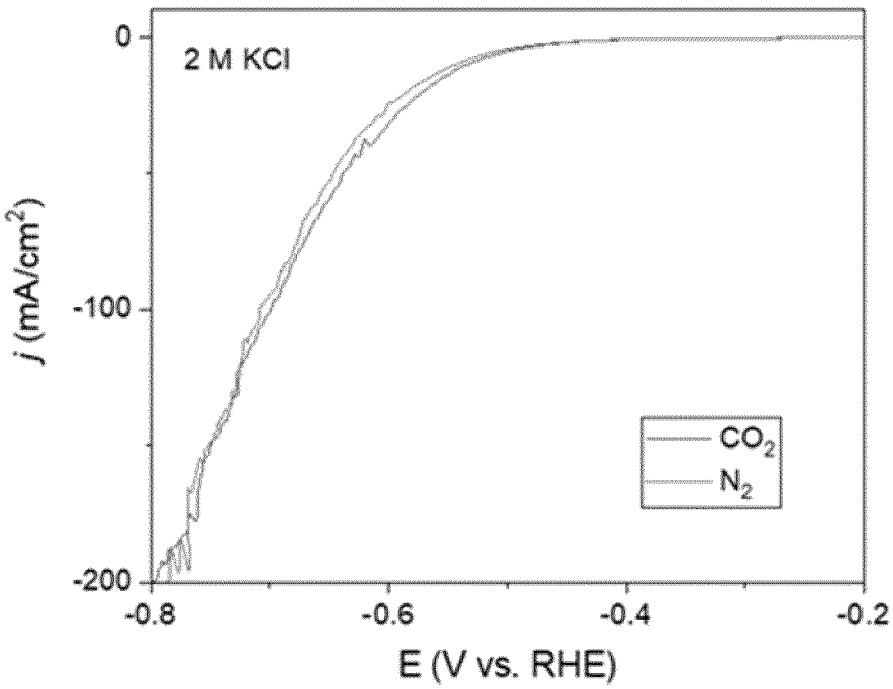
FIG. 27: The effect of 2M KCl addition to the 1 M $H_3PO_4$ on hydrogen evolution activity.
Figure 28:
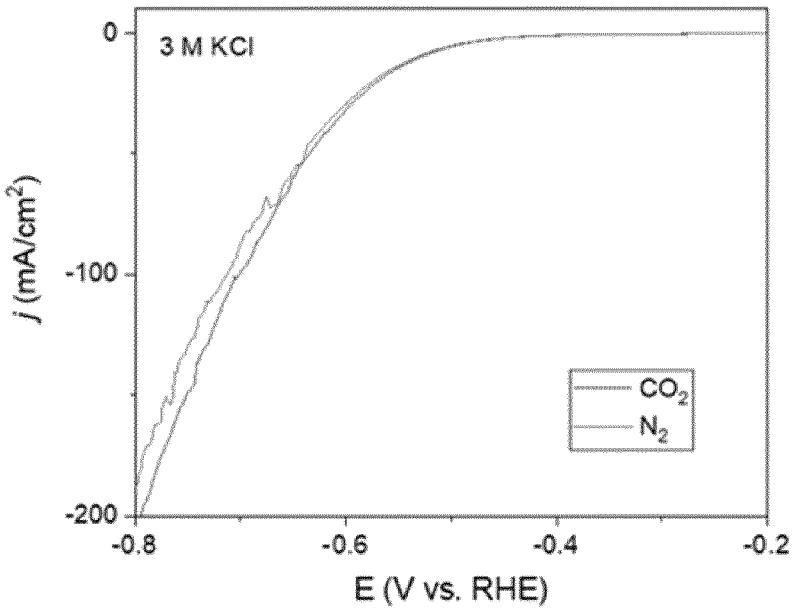
FIG. 28: The effect of 3M KCl addition to the 1 M $H_3PO_4$ on hydrogen evolution activity.
Figure 29:
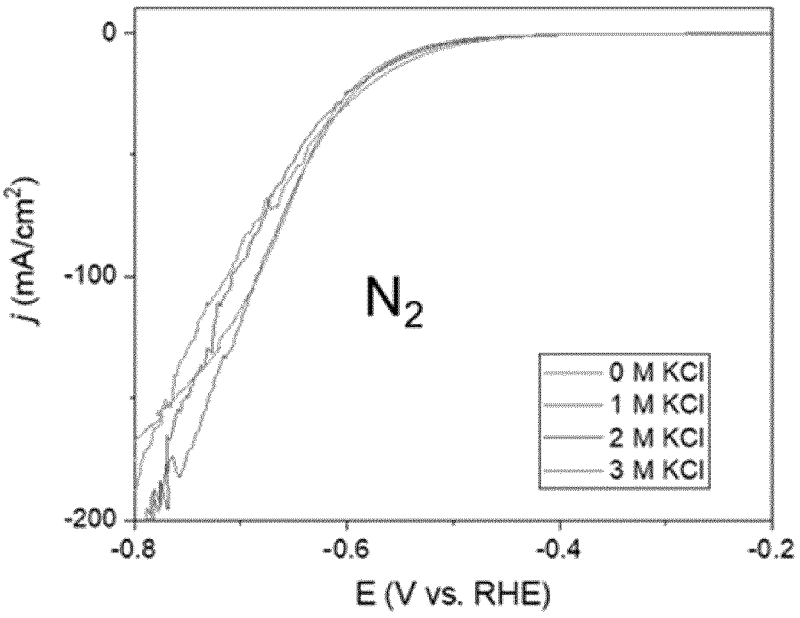
FIG. 29: The effect of KCl addition to the 1 M $H_3PO_4$ on hydrogen evolution activity (1 M $H_3PO_4$, 1 M $H_3PO_4$+1 M KCl, 1 M $H_3PO_4$+2 M KCl, and 1 M $H_3PO_4$+3 M KCl in $N_2$ saturated electrolyte with $N_2$ flow in the gas channel).
Figure 30:
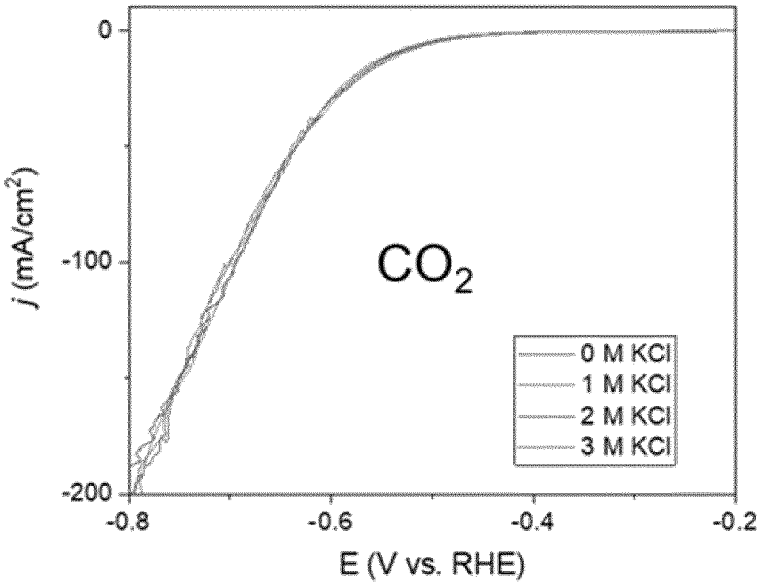
FIG. 30: The effect of KCl addition to the 1 M $H_3PO_4$ on hydrogen evolution activity (1 M $H_3PO_4$, 1 M $H_3PO_4$+1 M KCl, 1 M $H_3PO_4$+2 M KCl, and 1 M $H_3PO_4$+3 M KCl in $N_2$ saturated electrolyte with $CO_2$ flow in the gas channel).

To test this hypothesis, a Tafel analysis was carried out at different pH and the Tafel slope was found to decrease along with an increase in $K^+$ concentration in the electrolytes (FIG. 22). The slope reaches a minimum of 0.28 V/dec in the electrolyte of 1 M $H_3PO_4$ with 3 M KCl (pH 0.57). This suggests that the change in Tafel slope is not attributable to pH and that the rate determining step (RDS) is the adsorption of $CO_2$ (25). The presence of cations appears to play a role into $CO_2$ activation on the catalyst surface. Previous studies attributed the enhanced activation achieved with cations to their electrostatic interactions with the electric dipole of adsorbates or changes of surface charge density (30, 31). This activation enhancement on silver catalysts was assessed: in 1 M $H_3PO_4$ electrolyte, no $CO_2R$ reactivity was observed while ~50% $CO_2R$ selectivity was achieved in the presence of 3 M $K^+$ in the same electrolyte (FIG. 23). The $CO_2R$ selectivity was dependent on current density and the FE of the main $CO_2R$ product, $CH_4$, reached a maximum of 27% at 600 mA/$cm^2$ (FIG. 24).

Figure 31:
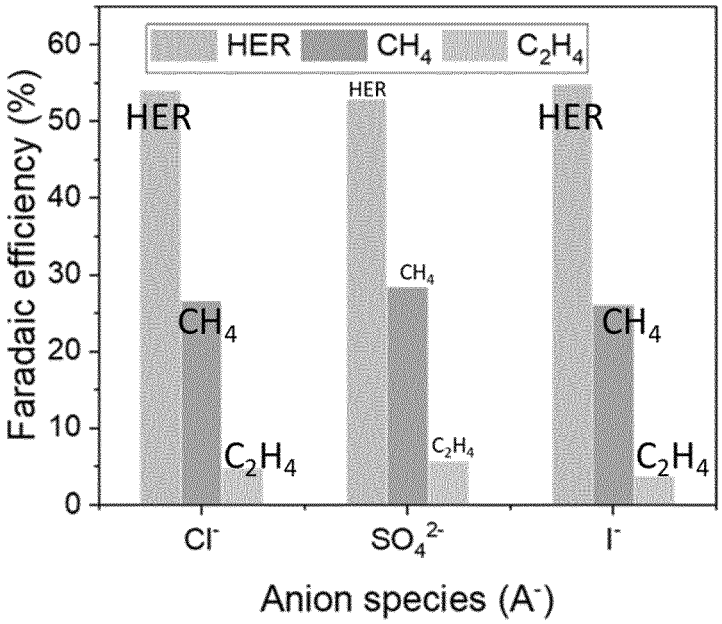
FIG. 31: Faradaic efficiency on the sputtered Cu under 400 mA/cm$^2$ in electrolyte of similar pH with different anions species. The electrolyte was 1 M $H_3PO_4$ solutions containing 1 M KCl, $K_2SO_4$ or KI.
Figure 32:
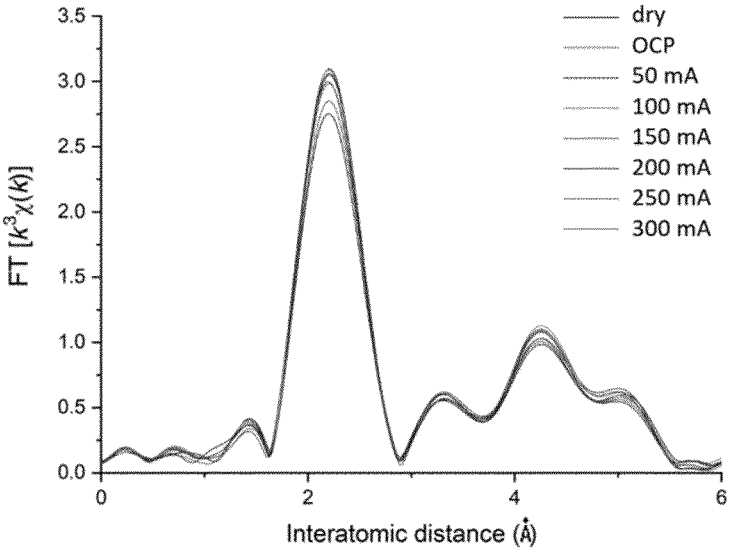
FIG. 32: In situ XAS measurement on the sputtered Cu catalyst. The XAS spectra showed only coordination of metallic Cu. OCP (open circuit potential).

The improvement of $CO_2R$ reactivity does not seem to come from suppression of HER in the presence of $K^+$. Indeed, voltametric analyses in 1 M $H_3PO_4$ with various concentrations of $K^+$ showed similar behaviour regardless of $N_2$ or $CO_2$ atmospheres (FIGS. 25 to 30). The effect of anions on $CO_2R$ reactivity is not significant: substitution of $SO_4^{2-}$ or $I^-$ for $Cl^-$ showed similar product distribution to $Cl^-$ case (FIG. 31). It is thus unlikely that the $K^+$ affects the oxidation state of Cu catalysts: only metallic Cu was observed by operando X-ray absorption spectroscopy (FIG. 32).

Figure 33:
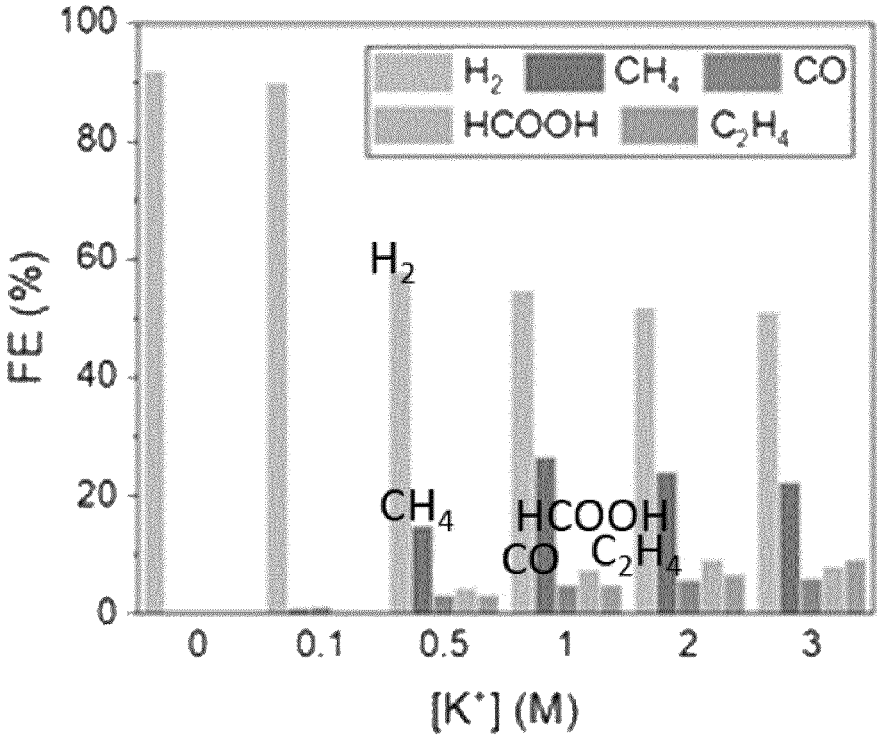
FIG. 33: Cation enables $CO_2$ reduction in acidic electrolyte. FE toward all products of sputtered Cu catalyst in 1 M $H_3PO_4$ with different KCl concentrations at 400 mA/cm$^2$.

$CO_2R$ product distribution in 1 M $H_3PO_4$ with different concentrations of $K^+$ and current density held constant at the applied current density of 400 mA/$cm^2$ (FIG. 33) was examined. The HER selectivity decreased and $CO_2R$ selectivity increased, with an increase in the $K^+$ concentration. Selectivity for $CH_4$ was the highest, at ~28%, for 1 M $K^+$. The FE toward $C_2H_4$, though not dominant, increased steadily from 3.1% with 0.5 M $K^+$ to 9.3% with 3 M $K^+$.

Figure 34:
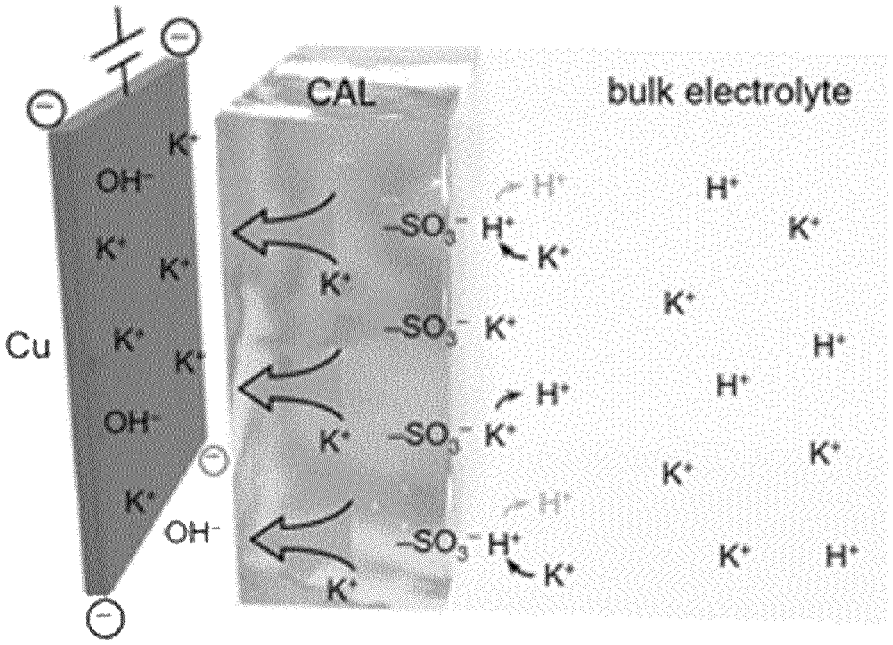
FIG. 34. Cation-augmenting layer (CAL) for multicarbon product formation and high carbon efficiency in acidic electrolyte. Schematic illustration of ionic environment and transport near the catalyst surface functionalized by the PFSA ionomer. The CAL is represented apart from the catalyst layer for sake of clarity, but it should be noted that the CAL is deposited onto the catalyst layer. All experiments were performed using 1 M $H_3PO_4$+3 M KCl catholyte.
Figure 35:
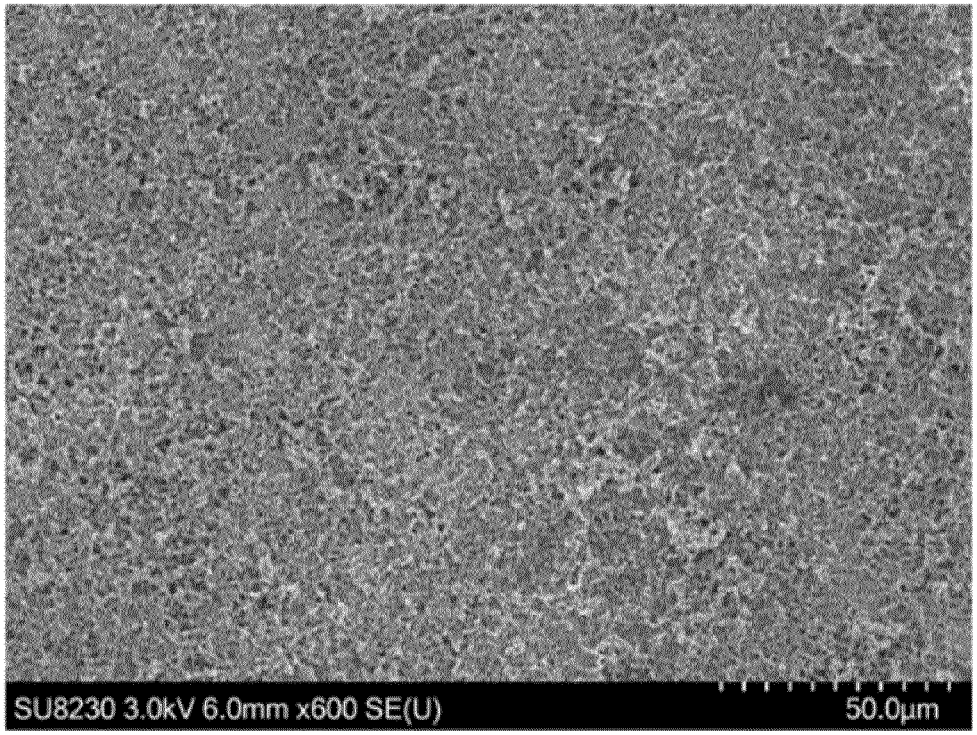
FIG. 35: SEM images of the CAL at the scale of 50.0 μm. The whole length of the bar on the SEM image corresponds to the scale. The CAL was composed of carbon nanoparticles (CNPs) blended with PFSA ionomers.
Figure 36:
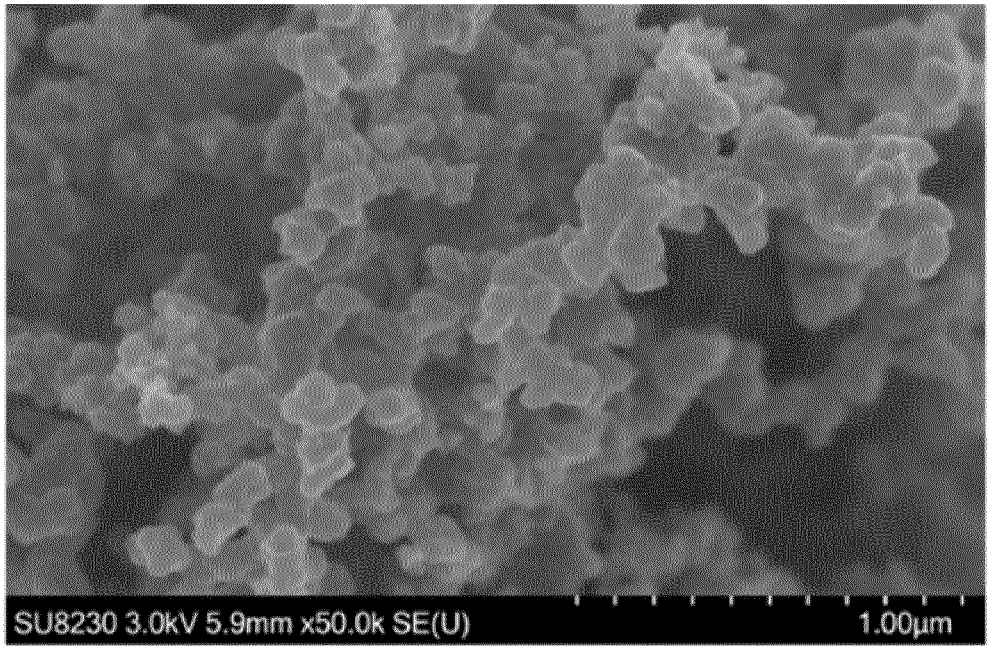
FIG. 36: SEM images of the CAL at the scale of 1.00 μm. The whole length of the bar on the SEM image corresponds to the scale. The CAL was composed of carbon nanoparticles (CNPs) blended with PFSA ionomers.
Figure 37:
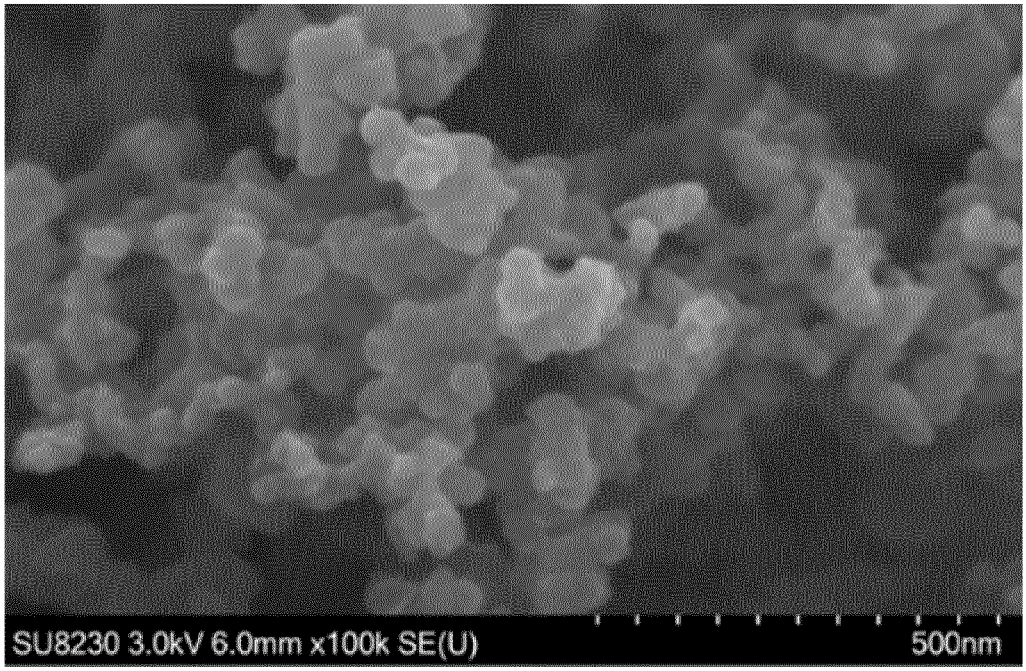
FIG. 37: SEM images of the CAL at the scale of 500 nm. The whole length of the bar on the SEM image corresponds to the scale. The CAL was composed of carbon nanoparticles (CNPs) blended with PFSA ionomers.

It was sought to steer selectivity further toward $C_2H_4$ in view of its high value and broad application in the chemical sector (32). However, the solubility of $K^+$ in aqueous electrolytes is limited while maintaining a low pH. In some implementations, a way to increase the concentration of cation species at the surface of the cathode can be to modify a surface of the cathode such that said surface is able to confine cation species. The cathode is said to include a cation-augmenting layer (CAL) comprising or consisting of a cation-augmenting material. The surface of the cathode can be functionalized with acidic groups that can exchange protons with the cation species of the catholyte. The cathode can include a catalyst material or catalyst layer such that the CAL is deposited onto the catalyst layer, or such that the cation-augmenting material is combined with the catalyst material in an active layer. For example, enrichment of cation species, such as potassium ions $K^+$, at the Cu surface by the CAL can be performed. The cation-augmenting material can include an ion conduction polymer, such as a cationic ionomer, e.g., a cationic perfluorosulfonic acid (PFSA) ionomer composed of tetrafluoroethylene and sulfonyl fluoride vinyl ether. The acidic —$SO_3H$ group can exchange protons with $K^+$ from the bulk electrolyte in a non-acidic local environment, sustaining a high $K^+$ concentration at the catalyst surface (FIG. 34). In addition, the CAL allows cations (e.g., $H^+$ and $K^+$) transport in the direction from electrolyte to catalyst surface while retarding $OH^-$ diffusing out, leading to higher local and surface pH that was reported to facilitates C—C coupling (10, 15, 33). The ionomer was loaded onto the sputtered Cu surface as a blend with carbon nanoparticles (NPs) in order to increase its adhesion to the catalyst (FIGS. 35 to 37). Functionalization of the catalyst material via the cation-augmenting material results in the formation of an electrode having a high-surface area, thereby providing gas channels for $CO_2$ and thus increasing the reaction sites for the catalyst material. A high-surface area corresponds to nanoparticles of a diameter ranging between 20 nm and 40 nm as determined by scanning electron microscopy and having a nominal mass loading ranging between 2 mg $cm^{-2}$ and 4 mg $cm^{-2}$.

Figure 38:
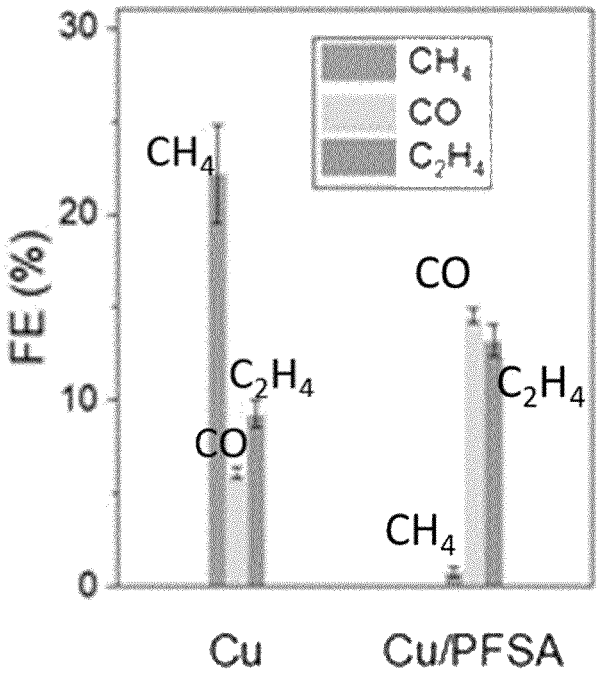
FIG. 38: Cation-augmenting layer (CAL) for multicarbon product formation and high carbon efficiency in acidic electrolyte. FEs toward gaseous $CO_2$R products on bare Cu and PFSA modified Cu (Cu/PFSA) at 400 mA/cm$^{-2}$ in 1 M $H_3PO_4$ with 3 M KCl. All experiments were performed using 1 M $H_3PO_4$+3 M KCl catholyte.
Figure 39:
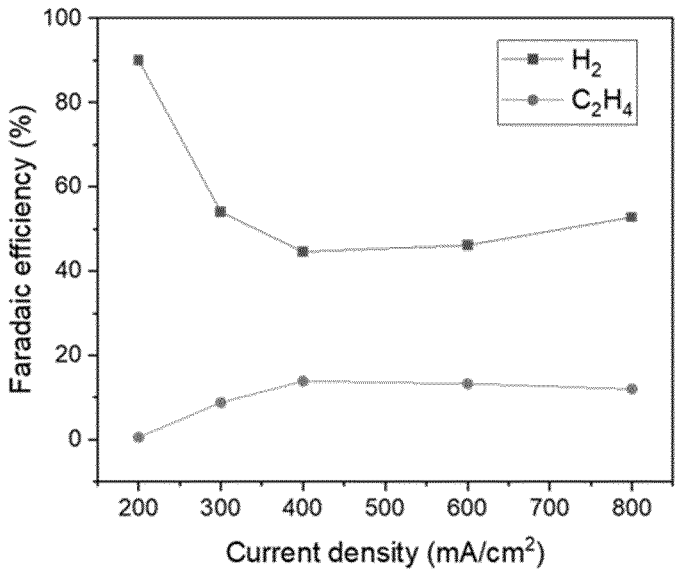
FIG. 39: Faradaic efficiency towards $C_2H_4$ on CAL-modified Cu electrode from 200 mA/cm$^2$ to 800 mA/cm$^2$ in 1 M $H_3PO_4$+3 M KCl electrolyte. The $C_2H_4$ FE remains above 10% in a current density between 300 mA/cm$^2$ and 800 mA/cm$^2$.
Figure 40:
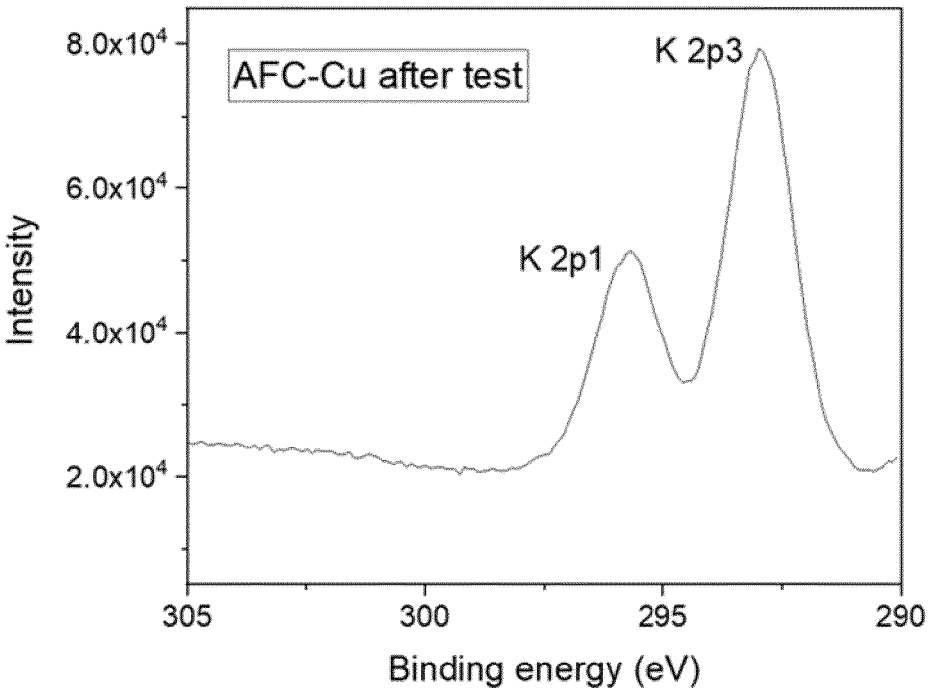
FIG. 40: K2p XPS of electrodes after testing in 1 M $H_3PO_4$+3 M KCl for 20 minutes. CAL-modified Cu electrode.
Figure 41:
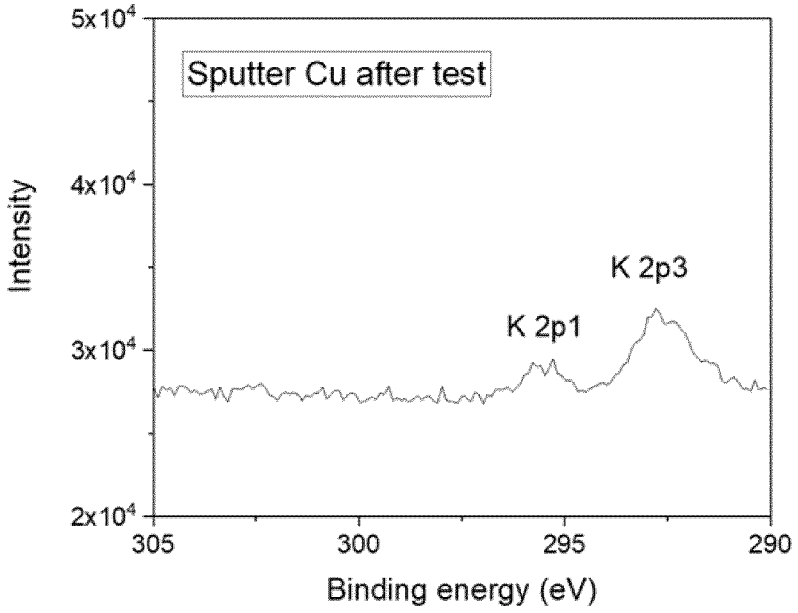
FIG. 41: K2p XPS of electrodes after testing in 1 M $H_3PO_4$+3 M KCl for 20 minutes. Bare sputtered Cu electrode. A slight K content is detected on the surface of pure sputtered Cu upon completion of the test, which might be due to the crystalized salts from the electrolyte, while a large amount of K content was detected on the surface of the CAL-modified Cu electrode.

The CAL-modified Cu showed a further increase of FE toward $C_2H_4$ to 13% and a much lower FE toward $CH_4$ of <1% comparing to the bare Cu catalyst, while the remaining $CO_2R$ gaseous product was CO at a current density of 400 mA/$cm^2$ in 1 M $H_3PO_4$ with 3 M KCl (FIG. 38). The product selectivity shift was attributed to electrostatic interactions of cation species (e.g., $K^+$) with the electric dipole of specific adsorbates that favors $C_{2+}$ reaction pathways (31, 34). The FE toward $C_2H_4$ was around 10% for current densities in the range 300-800 mA/$cm^2$ (FIG. 39). X-ray photoelectron spectroscopy (XPS) showed a marked increase of potassium on CAL-modified Cu surface compared with that on bare Cu after $CO_2R$ operation (FIGS. 40 and 41), confirming the preservation of $K^+$ by the ionomer layer.

Figure 42:
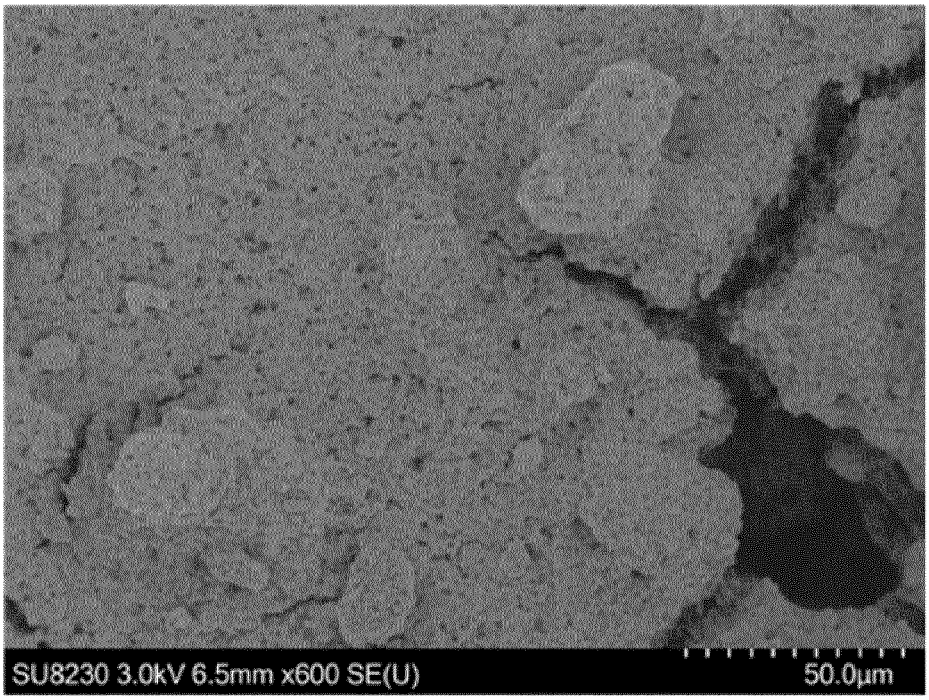
FIG. 42: SEM images of the high-surface area CAL-modified Cu-NPs/PFSA electrode at the scale of 50.0 μm. The whole length of the bar on the SEM image corresponds to the scale. Cu NPs are surrounded by PFSA ionomers.
Figure 43:
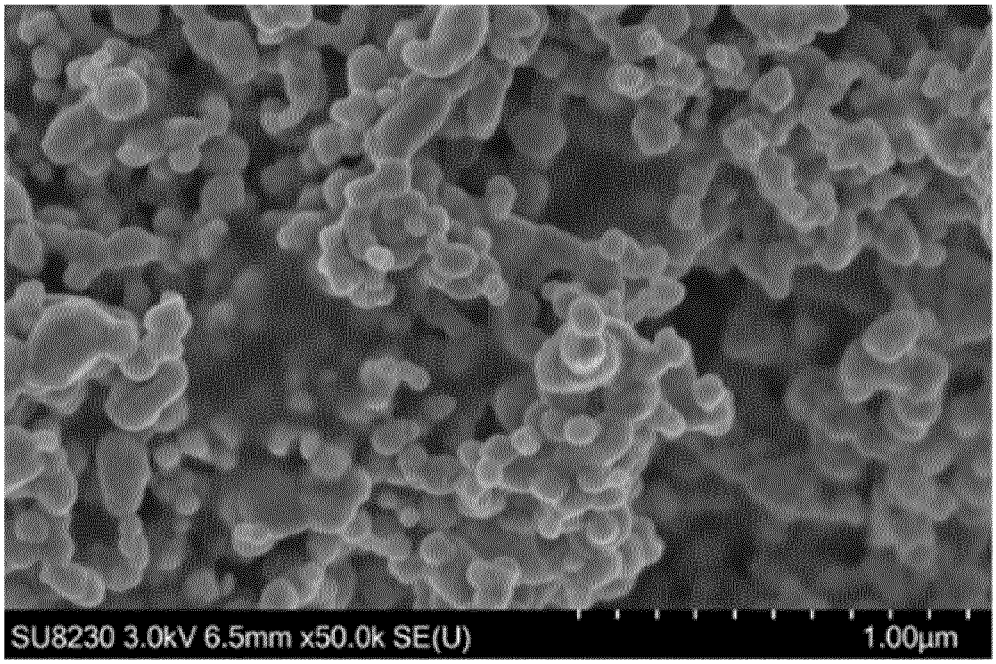
FIG. 43: SEM images of the high-surface area CAL-modified Cu-NPs/PFSA electrode at the scale of 1.00 μm. The whole length of the bar on the SEM image corresponds to the scale. Cu NPs are surrounded by PFSA ionomers.
Figure 44:
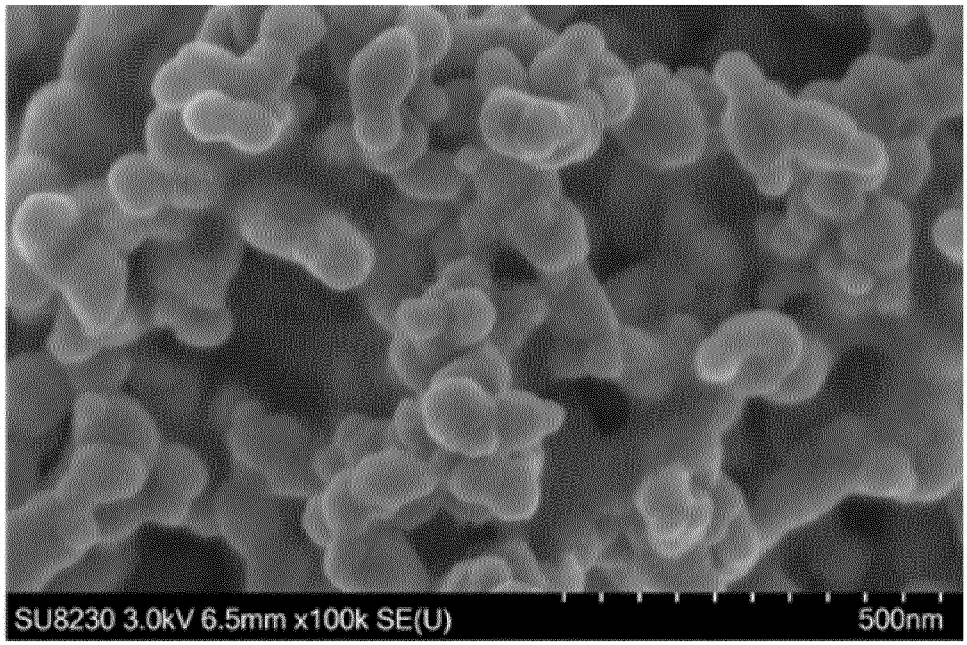
FIG. 44: SEM images of the high-surface area CAL-modified Cu-NPs/PFSA electrode at the scale of 500 nm. The whole length of the bar on the SEM image corresponds to the scale. Cu NPs are surrounded by PFSA ionomers.
Figure 45:
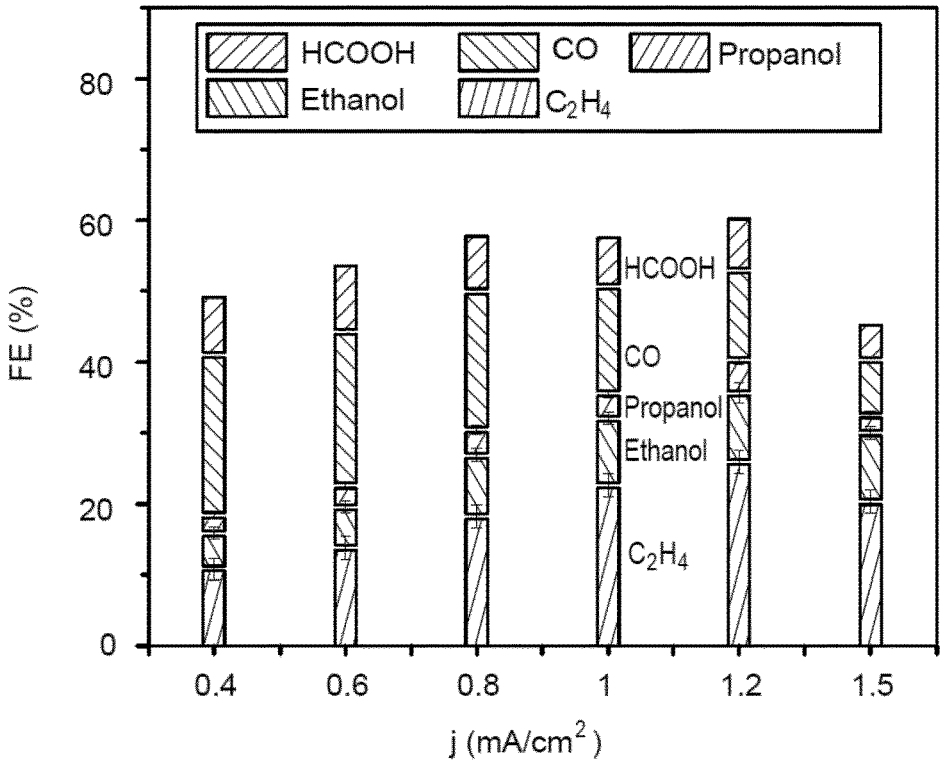
FIG. 45: Cation-augmenting layer (CAL) for multicarbon product formation and high carbon efficiency in acidic electrolyte. FEs toward $CO_2$R products at 400-1,500 mA cm$^{-2}$ on cation-augmenting layer (CAL)-modified Cu electrode. The flow rate of $CO_2$ inlet was 50 sccm. All experiments were performed using 1 M $H_3PO_4$+3 M KCl catholyte.
Figure 46:
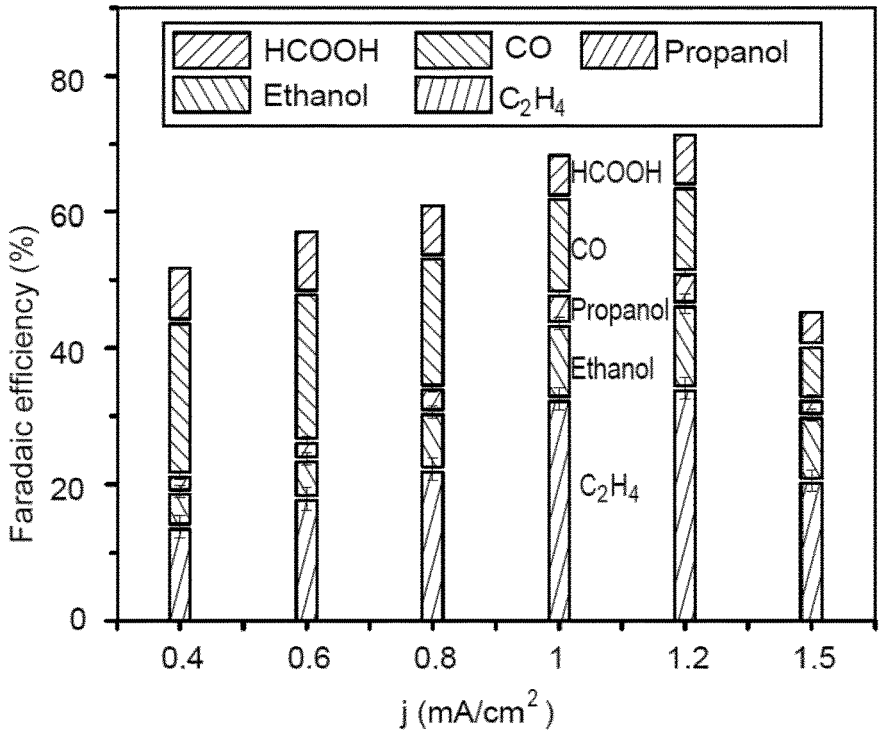
FIG. 46: Cation-augmenting layer (CAL) for multicarbon product formation and high carbon efficiency in acidic electrolyte. FEs toward $CO_2R$ products at 400-1,500 mA $cm^{-2}$ on CAL-modified Cu electrode. The flow rate of $CO_2$ inlet was 5 sccm. All experiments were performed using 1 M $H_3PO_4$+3 M KCl catholyte.
Figure 47:
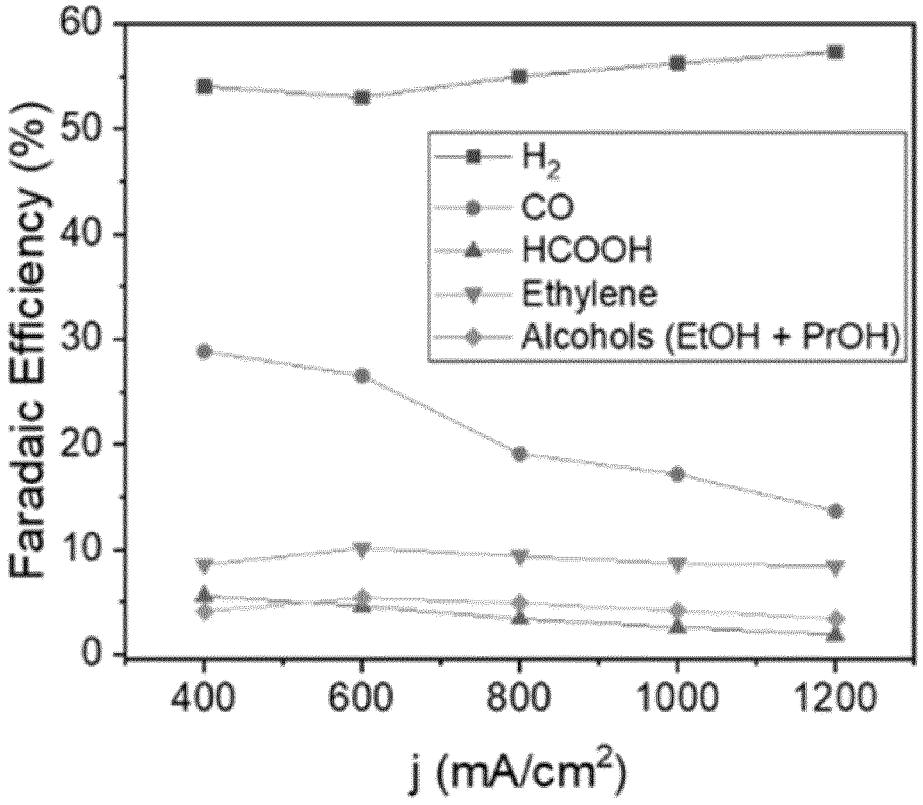
FIG. 47: Faradaic efficiency distributions on CAL-modified Cu NP electrode at various current densities in 1 M $H_3PO_4$ electrolyte with 1M KCl.
Figure 48:
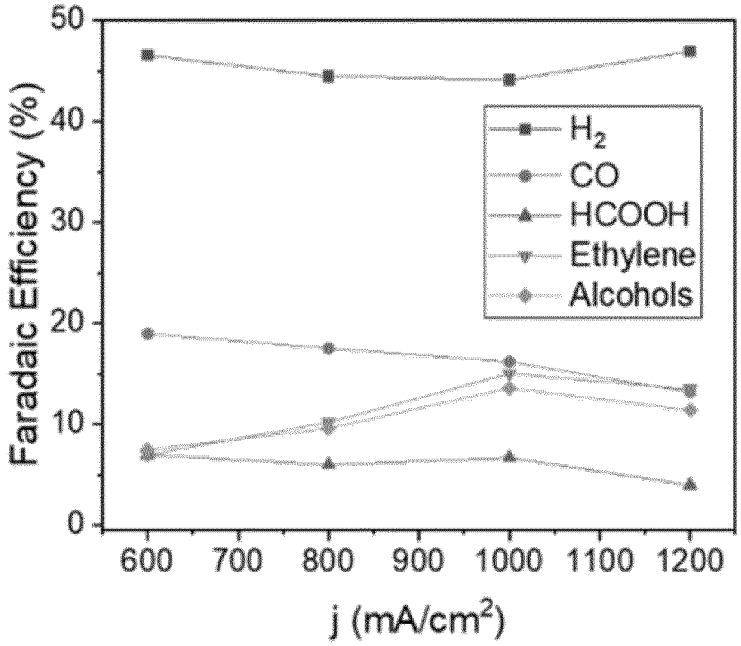
FIG. 48: Faradaic efficiency distributions on CAL-modified Cu NP electrode at various current densities in 1 M $H_3PO_4$ electrolyte with 2M KCl.
Figure 49:
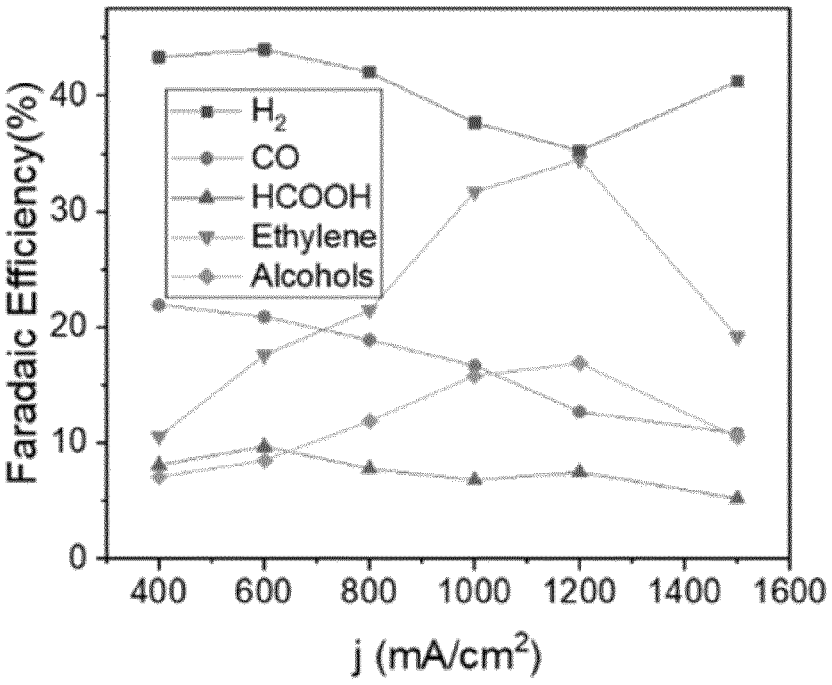
FIG. 49: Faradaic efficiency distributions on CAL-modified Cu NP electrode at various current densities in 1 M $H_3PO_4$ electrolyte with 3M KCl.

To improve $CO_2R$ productivity still further, the electrochemically active surface area of the electrode was increased by forming a Cu-NPs/PFSA composite material (FIGS. 42 to 44) (7, 35). Similar to the case of bare Cu, the $CO_2R$ selectivity was dependent on the bulk concentration of $K^+$ in 1 M $H_3PO_4$: the FE toward $C_2H_4$ increased from around 10% with 1 M $K^+$ to 26% with 3 M $K^+$ at a current density of 1.2 A/$cm^2$ (FIGS. 45 to 49). The overall $CO_2R$ selectivity reached 61% including a total $C_{2+}$ FE of 40%.

$CO_2R$ in acid enables $CO_2$ electrolysis without carbonate formation and crossover, circumventing the $CO_2$ utilization limit that is fundamental to neutral and alkaline systems, and permitting a carbon efficiency that is capable of increasing further in the direction of unity. To reduce energy demand of product separation from dilute streams (36), single-pass carbon efficiency (SPCE) toward the new theoretical limit was pursued.

Figure 50:
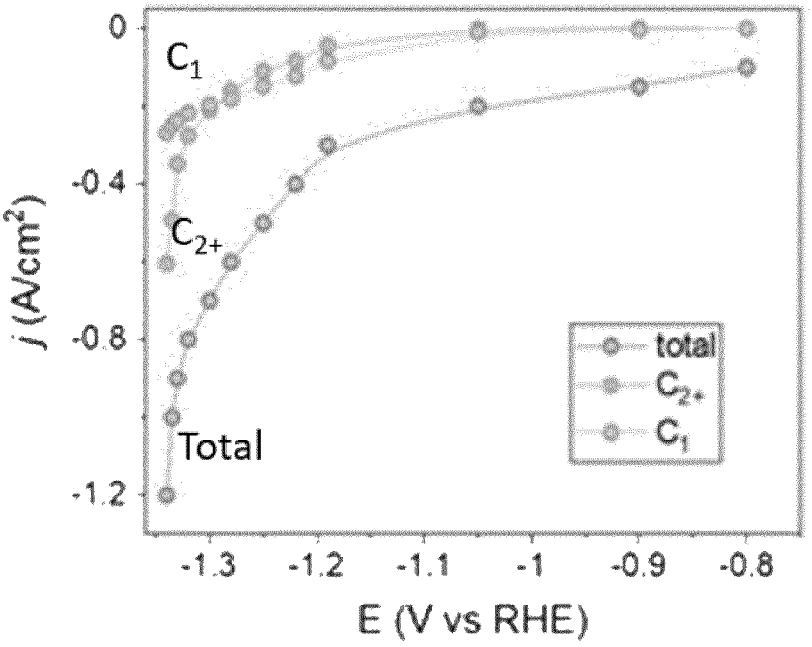
FIG. 50: Cation-augmenting layer (CAL) for multicarbon product formation and high carbon efficiency in acidic electrolyte. Current density toward $CO_2R$ products at 800-1,500 mA $cm^{-2}$ on CAL-modified Cu electrode. The flow rate of $CO_2$ inlet was 5 sccm. All experiments were performed using 1 M $H_3PO_4$+3 M KCl catholyte.
Figure 51:
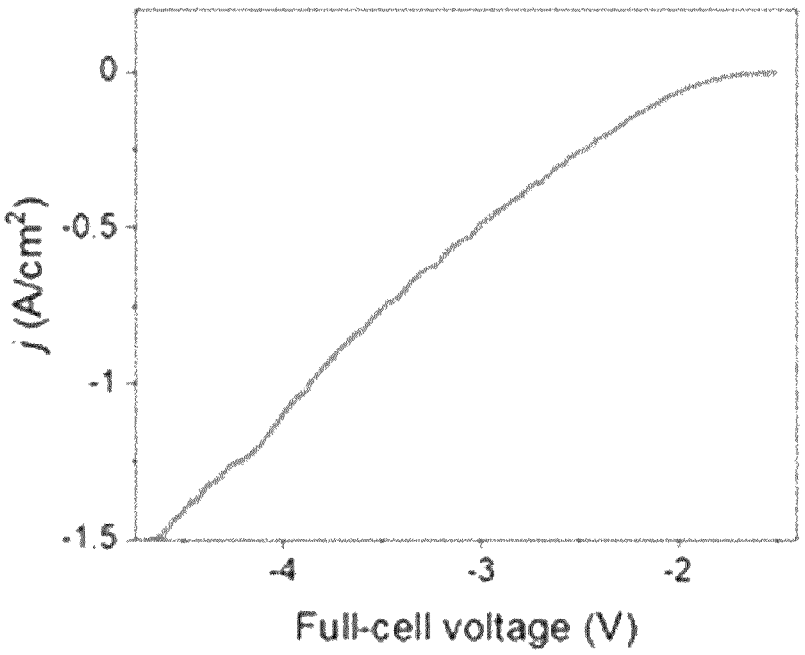
FIG. 51: Cation-augmenting layer (CAL) for multicarbon product formation and high carbon efficiency in acidic electrolyte. Current-voltage curve of CAL-modified Cu electrode in a slim flow cell. $IrO_x$/Ti was used as the anode, and Nafion™ was used as the membrane. No iR compensation was applied. All experiments were performed using 1 M $H_3PO_4$+3 M KCl catholyte.
Figure 52:
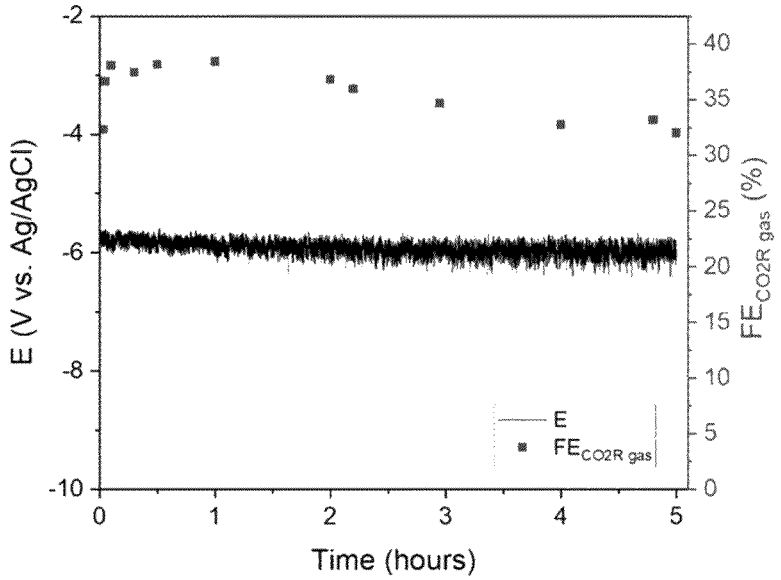
FIG. 52: Extended $CO_2RR$ performance of the CAL-modified Cu NP electrode in 1 M $H_3PO_4$+3 M KCl.
Figure 53:
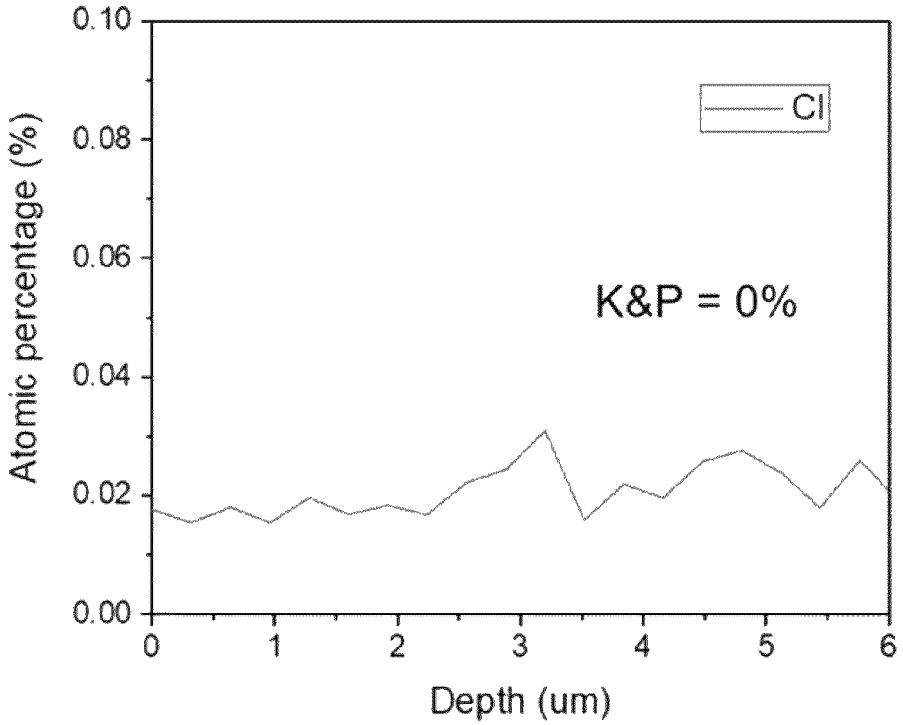
FIG. 53: In-depth elemental profile of CAL-modified electrodes via sputtering XPS. As made CAL-modified electrode.
Figure 54:
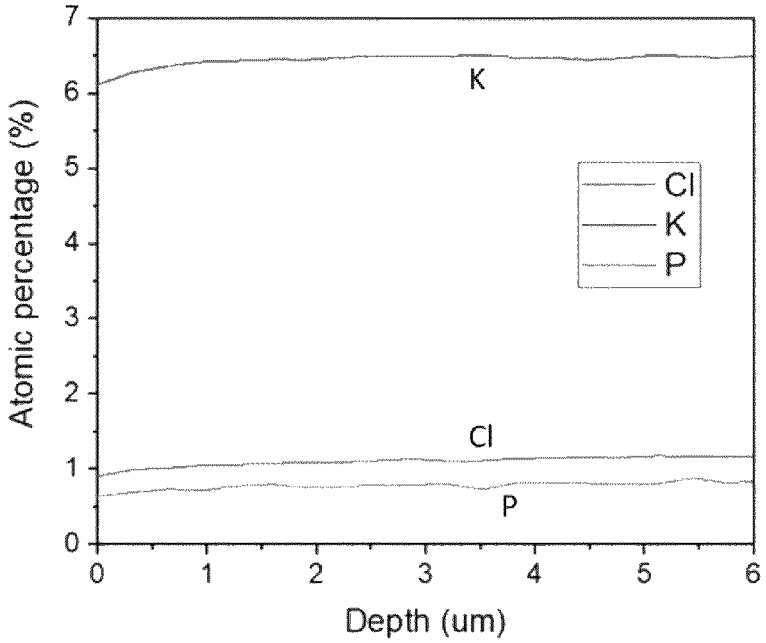
FIG. 54: In-depth elemental profile of CAL-modified electrodes via sputtering XPS. CAL-modified electrode after $CO_2R$ in 1 M $H_3PO_4$ and 3 M KCl electrolyte for 20 minutes at 1200 mA/$cm^2$. An even distribution of K species within the catalyst layer after $CO_2R$ was observed, much higher content than the bias species Cl and P that come from the crystalized salts from the electrolyte. To prevent a bias that might come from crystalized KCl or potassium phosphate, the surface was rinsed with 0.1 M $H_3PO_4$ after the reaction.

By gradually reducing the flow rate of $CO_2$ from 50 to 5 standard cubic centimeters per minute (sccm), the $C_{2+}$ FE was improved to 49% (34% toward $C_2H_4$, 11% toward $C_2H_5OH$, and 4% toward $C_3H_7OH$). This combination of current density and selectivity results in a high overall $C_{2+}$ productivity of 600 mA/$cm^2$ (FIG. 50). Employing a slim, low-resistance flow cell (7), a full-cell energy efficiency (without benefit from iR compensation) of 14% toward $C_{2+}$ products at a current density of 1.2 A/$cm^2$ (FIG. 51) was achieved. The $CO_2R$ operated stably at 1.2 A/$cm^2$ in an initial 5-hour test (FIG. 52). In-depth XPS analyses indicate that K distributed evenly across the top layer of the composite electrode after $CO_2R$ reaction (FIGS. 53 and 54). The percentages of Cl and P were 5× lower than that of K, suggesting that the observed K concentration was sustained by the ionomer, not caused by residual electrolyte salts.

Figure 2:
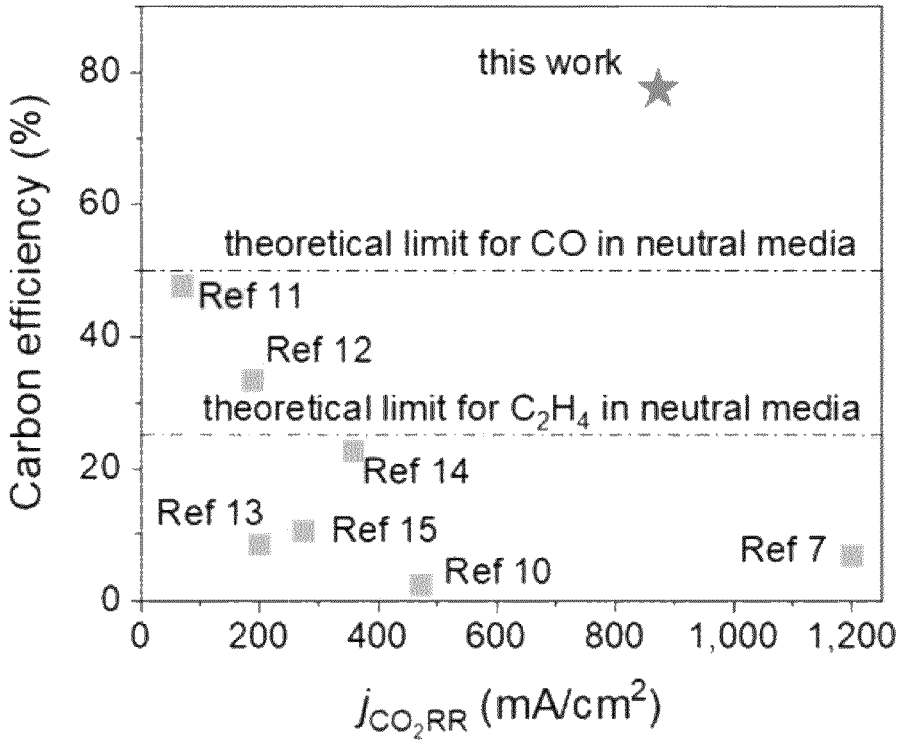
FIG. 2: Acidic $CO_2$ reduction vs. alkaline and neutral $CO_2$ reduction. Comparison of carbon efficiency and current density in the benchmark alkaline and neutral $CO_2R$ electrolyzers (7, 10-15). The dash lines indicate theoretical carbon efficiency for CO and $C_2H_4$, respectively, in neutral media. Carbon efficiency in alkaline media is lower than in neutral media due to additional consumption of $CO_2$ by bulk $OH^-$.
Figure 3:
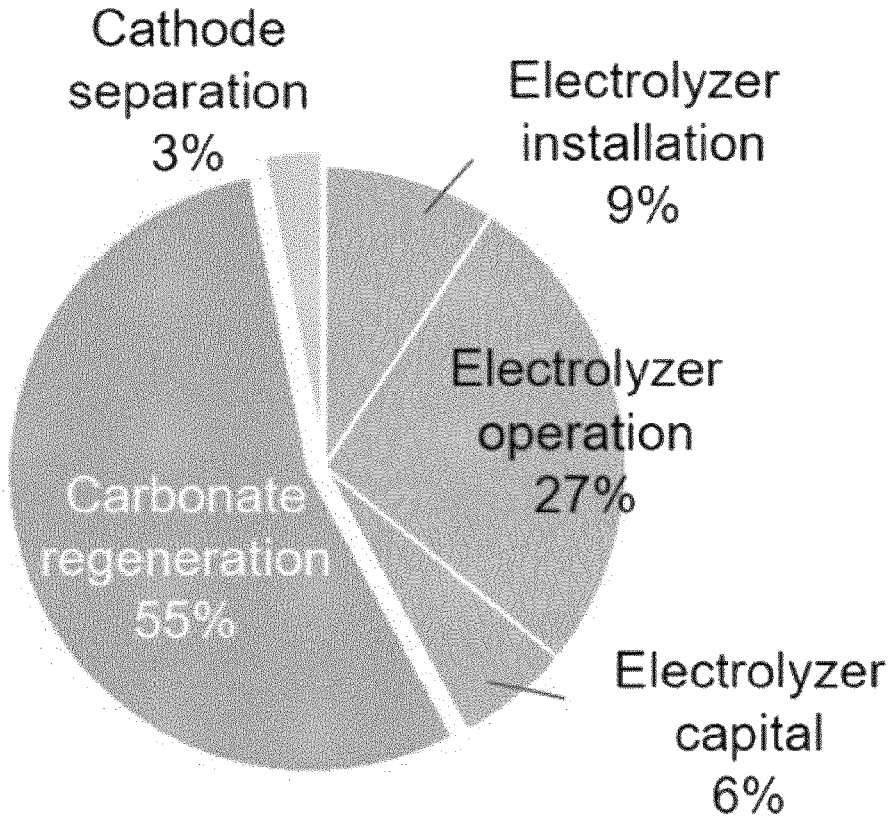
FIG. 3: Acidic $CO_2$ reduction vs. alkaline and neutral $CO_2$ reduction. Cost breakdown of an alkaline $CO_2R$ flow cell based on technoeconomic analysis (see also tables 1-2).
Figure 55:
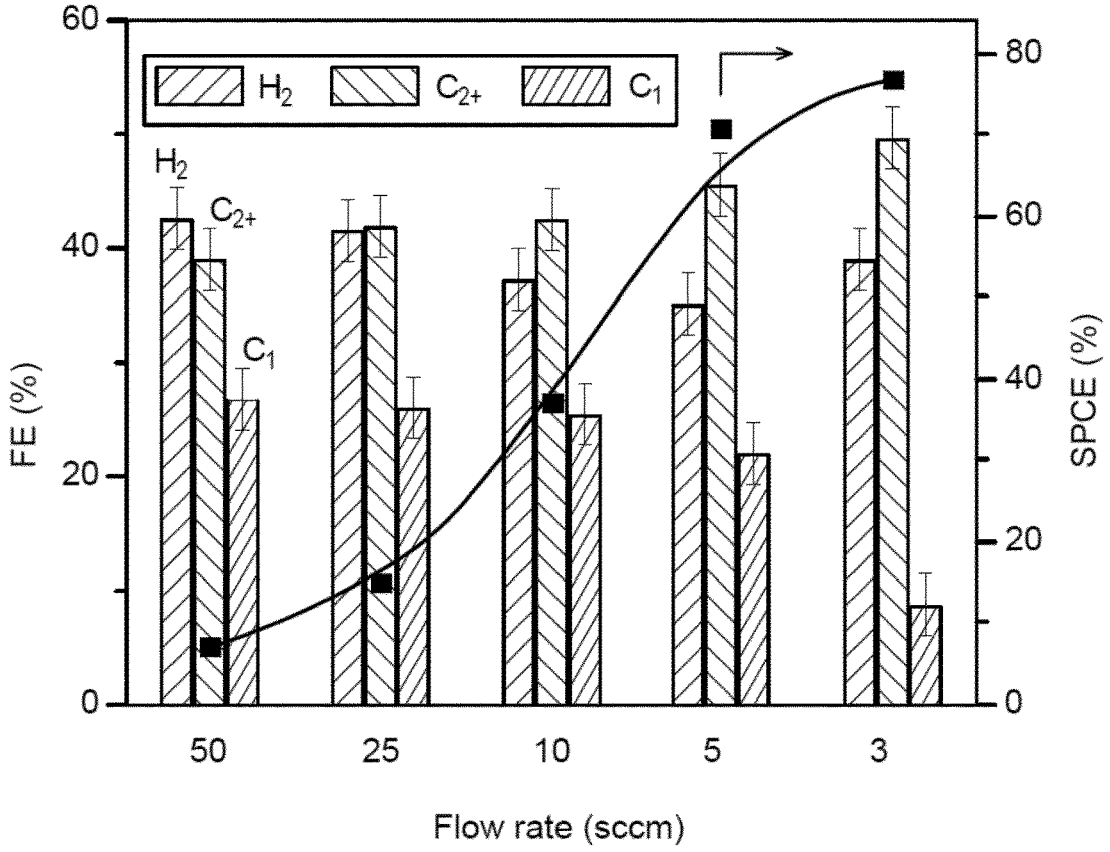
FIG. 55: Cation-augmenting layer (CAL) for multicarbon product formation and high carbon efficiency in acidic electrolyte. FEs toward $H_2$ and $CO_2R$ products as well as single-pass carbon efficiency (SPCE) on CAL-modified Cu electrode at 1.2 A $cm^{-2}$ with different $CO_2$ flow rate. All experiments were performed using 1 M $H_3PO_4$+3 M KCl catholyte.
Figure 56:
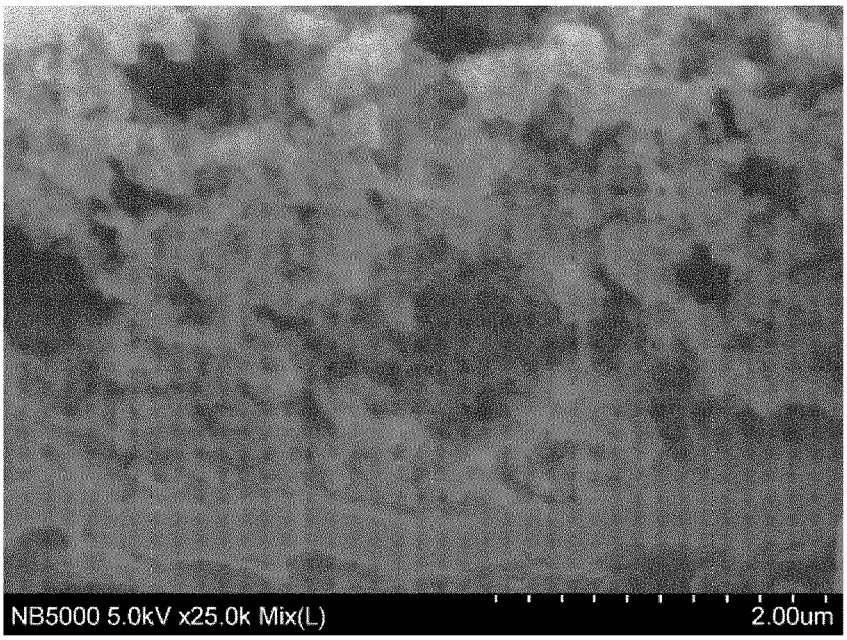
FIG. 56: Cross-sectional scanning electron microscopy measurements image of the the metal-based catalyst material, indicating that the metal-based catalyst material has a thickness ranging between 2 and 3 μm. The whole length of the bar on the SEM image corresponds to the scale. Such kind of measurements confirm the metal-based catalyst layer's thickness that can be controlled by the deposition parameters (mass loading).

By further lowing the flow rate of $CO_2$ to 3 sccm, an SPCE of ~77% for all the $CO_2R$ products, including ~50% for $C_{2+}$ products (FIG. 55) was achieved, at a current density of 1.2 A/$cm^2$. This outperforms previously-reported alkaline and neutral $CO_2R$ electrolyzers (FIG. 2 and table 6).

TABLE 6

Summary of state-of-art carbon efficiency in the benchmark alkaline and neutral $CO_2R$ electrolyzers.

| Electrolyte pH, products | Single pass carbon efficiency (%) | Reference |
|---|---|---|
| pH~7, CO | 47.5 | 11 |
| pH~7, CO | 33.1 | 12 |
| pH~14, CO | 8.2 | 13 |
| pH~14, CO and $C_{2+}$ | 10.4 | 14 |
| pH~14, CO, formate and $C_{2+}$ | 22.5 | 15 |
| pH~15, $C_2H_4$ | 2.2 | 16 |
| pH~15, $C_2H_4$ | 6.7 | 17 |
| pH 0.57, CO, formate and $C_{2+}$ | 77.4 | This work |

It should be noted that the flow rate values exemplified and claimed herein correspond to inlet flow rate values for feeding $CO_2$ to a cathode at a laboratory scale for experimentation. One skilled in the art can understand that various of the tested parameters can be adapted to perform the described methods at a larger industrial scale, for example.

The cation augmentation takes $CO_2$ electrolysis from high-pH neutral and alkaline electrolytes to pH<1 acidic environment. This work solves the carbonate regeneration and $CO_2$ crossover challenge, and sets a new benchmark for carbon utilization and the viability of electrochemical $CO_2$ conversion.

Test and Determination Methods

Catalysts and Chemicals Preparation

All the chemicals used for electrolytes and catalyst synthesis, including phosphoric acid (85%), potassium chloride, potassium phosphate monobasic, potassium sulfate, potassium iodide, potassium hydroxide, sulfuric acid, perchloric acid, Aquivion (D79-25BS), Cu nanoparticles (25 nm), carbon nanoparticles and graphite, were purchased from Sigma Aldrich. Nafion™ 117 membrane (Nafion™ 117 indicates an extrusion-cast membrane with 1100 g/mol equivalent weight (EW) and 0.007 inches (7 thou) in thickness) and platinum mesh (grid aperture of 0.98×1.4 mm; purity 99.95%) were purchased from Fuel Cell Store. The polytetrafluoroethylene (PTFE) gas diffusion layer with 450 nm pore size was purchased from Beijing Zhongxingweiye Instrument Co., Ltd. Deionized water (18.2 MΩ) was used for all the electrolytes preparation. Cu and Ag were sputtered onto the PTFE substrate using pure Cu and Ag targets (>99.99%) in a vacuum environment ($10^{-5}$~$10^{-6}$ Torr) in an Angstrom Nexdep sputtering system. The deposition rate was kept constant at 1 Å/sec. The thickness of the catalyst layer was kept constant for all the electrodes to 300 nm, as determined by SEM. Cation-augmenting layer (CAL) is a 2 μm-thick homogeneous blend of carbon NPs (50 nm, Vulcan XC-72R) and Aquivion. The CAL-modified Cu was prepared by spray coating the CAL solution dispersed in methanol onto a 300 nm-Cu sputtered hydrophobic PTFE substrates. CAL-modified Cu-NPs/PFSA was prepared by spray coating the following dispersion onto a PTFE substrate with 300 nm sputtered Cu in sequence: 6 μm-thick homogeneous blend of Cu nanoparticles and Aquivion, a 2 μm-thick homogeneous blend of C NPs and Aquivion, and a 2 μm-thick homogeneous blend of graphite flakes (325 mesh, <44 μm, 99%, Sigma Aldrich) and Aquivion.

Flow Cell Assembly

The flow cell setup was composed of three chambers: anolyte chamber, catholyte chamber, and gas flow chamber. The size of the electrode exposed was 1 cm×1 cm. The cathode GDE of interest was clamped between catholyte chamber and gas diffusion chamber, with the substrate side facing the gas chamber and catalyst side (or CAL) facing the catholyte chamber. A Pt foil was employed in the anolyte chamber. The catholyte and anolyte chambers were separated by a cation exchange membrane (CEM, Nafion™ 117). The catholyte chamber contained an Ag/AgCl reference electrode (3M KCl).

Catholyte and anolyte were applied through separate silicone tubes that each connected to a peristaltic pump, offering a constant flow rate of approximately 10 mL/min. Electrolytes going through the pumps first entered each chamber from the bottom and exited from the top and flows back to their bulk electrolyte which forms a close cycle. For the gas supply, a digital mass flow controller (SmartTrack 100, Sierra) was connected to $CO_2/N_2$ gas cylinder to control the flow rate in gas flow chamber. The $CO_2$ gas and $N_2$ gas cylinders were purchased from Linde Gas.

Electrochemical Measurement

All the electrochemical tests were carried out using an electrochemical workstation (Autolab PGSTAT302N) connected to a current booster (Metrohm Autolab, 10 A), except for the linear sweeping voltammetry (LSV) tests, which were performed via a CHI 660E potentiostat. The catholyte of pH 1 or lower was prepared using 1 M phosphoric acid as the base electrolyte, with the incorporation of different salts at various concentrations. The most frequently used salt was potassium chloride, with the highest concentration of 3 M (pH 0.57).

The $CO_2$ reduction ($CO_2R$) performance was tested in a flow cell assembly under galvanostatic mode. 1 M phosphate buffer solutions with different salts and concentrations were used as catholyte, and 1 M phosphoric acid was used as anolyte. Cu on PTFE (300 nm), CAL-modified Cu and Cu-NPs/PFSA were used as cathodes in different tests.

LSV was taken in the same flow cell setup that is used for performance evaluation and the electrolytes were saturated with $N_2$ through continuous bubbling. Sputtered Cu on PTFE (300 nm), Ag/AgCl (3 M KCl), and a Pt foil were used as working, reference, and counter electrodes, respectively. The scan rate was kept constant at 50 mV/s. Phosphate was used as catholyte, in which the total phosphate concentration was kept constant as 1 M. 0.5 M $H_2SO_4$ was used as the anolyte. The cathode and anode chambers were separated by a CEM (Nafion™ 117). For LSVs of different pH, the total potassium concentration was kept as 2 M to sustain a high ion conductivity and achieve high current density. In detail, the catholyte of pH 1 was prepared using 1 M $H_3PO_4$ and 2 M KCl, and the pH was adjusted to around 1 (0.96) by a few drops of 5 M KOH. The catholyte of pH 2 was prepared using 0.5 M $H_3PO_4$, 0.5 M $KH_2PO_4$, and 1.5 M KCl, and the pH was adjusted to 1.94 through the addition of KOH. The catholyte of pH 3 was prepared using 0.1 M $H_3PO_4$, 0.9 M $KH_2PO_4$, and 1.1 M KCl, and the pH was adjusted to 2.94 through the addition of KOH. The catholyte of pH 4 was prepared using 1 M $KH_2PO_4$, and 1 M KCl, and the pH was adjusted to 3.96 by KOH. For the LSVs of different concentrations of potassium, KCl was added to 1 M $H_3PO_4$ electrolyte to supply the desired concentration of potassium. The pH of 0, 1, 2, and 3 M potassium were 0.85, 0.81, 0.70, and 0.57, respectively. All potentials were converted to RHE scale via the equation:

$$E(RHE)=E(\mathrm{Ag/AgCl})+0.059\times \mathrm{pH}+0.210+iR$$

where R was measured at open circuit potential and 80% of iR was compensated by the CHI software. Unless otherwise stated, the volumes of catholyte and anolyte used for circulation were 25 mL, and the liquid products were collected after 1 hour of operation for analysis. The current density reported are based on the geometric surface area.

Carbonate/$CO_2$ Crossover Test $CO_2$ crossover was measured at a constant current density of 400 mA/cm$^2$ for 6 hours. For the neutral electrolyte, both anolyte and catholyte concentrations (25 mL for each) were 1 M $KHCO_3$, which were saturated with $CO_2$ prior to the experiment. For the acidic conditions, the anolyte (25 mL) was 0.5 M $H_2SO_4$, and the catholyte (25 mL) was 1 M phosphate buffer solution. 2 M of KCl was added to the catholyte to improve the ion conductivity. The $CO_2$ flow rate was kept constant at 50 sccm using a mass flow controller (Alicat Scientific). The gas products collected from the anodic outlet were analyzed by a gas chromatography (PerkinElmer Clarus 680). The pH of catholyte and anolyte were monitored by a pH meter.

$CO_2RR$ Product Analysis

The gas products were collected from the gas outlet channel of the flow cell and injected into a gas chromatograph (PerkinElmer Clarus 680). The gas chromatograph was equipped with a thermal conductivity detector (TCD) for detection of $H_2$, $O_2$, $N_2$ and CO signals and a flame ionization detector (FID) for the detection of $CH_4$ and $C_2H_4$ signals. The gas chromatograph was composed of packed columns of Molecular Sieve 5A and Carboxen-1000 and employed Argon (Linde, 99.999%) as the carrier gas. For quantification, 1 mL of gas product was injected into the gas chromatograph, and the performance was evaluated as a function of current density, gas flow rate and gas products fraction.

$$\text{Faradaic efficiency (\%)}=N\times F\times v\times r/(i\times V_m)$$

where N is the number of electrons transferred, F is the Faradaic constant, v is the gas flow rate, r is the concentration of detected gas product in ppm, i is the total current, and $V_m$ is the unit molar volume of gas. The gas flow rate was measured at the outlet of the gas chamber by a bubble flow meter.

The liquid products were analyzed using $^1$H NMR spectroscopy (600 MHz Agilent DD2 NMR Spectrometer) with water suppression. Dimethyl sulfoxide (DMSO) was used as the reference standard and deuterium oxide ($D_2O$) as the lock solvent. The Faradaic efficiency was calculated using the equation below:

$$\text{Faradaic efficiency (\%)}=N\times F\times n_{product}/Q$$

where N is the number of electrons transferred, F is the Faradaic constant, $n_{product}$ is the total moles of products, and Q=i×t is the total charged passed during the experiment.

The single pass carbon efficiency (SPCE) of $CO_2$ towards each product or a group of products was determined using this equation at 25° C., 1 atm:

$$SPC=(j\times 60\text{ sec})/(N\times F)\div(\text{flow rate (L/min)}\times 1\text{ (min)})/(24.05\text{ (L/mol)})$$

Where j is the partial current density of specific group of products from $CO_2$ reduction, N is the electron transfer for every product molecule.

Materials Characterizations

Scanning electron microscopy (SEM) was performed in a high-resolution scanning electron microscope (HR-SEM, Hitachi S-5200).

X-ray photoelectron spectroscopy (XPS) were carried out in an ECSA device (PHI 5700) with Al Kα X-ray energy source (1486.6 eV) for excitation. Prior to measurements, the catalysts were rinsed sequentially with 1 M $H_3PO_4$ and DI water to remove any potential residual salt from the surface.

Operando hard X-ray absorption spectroscopy measurements were conducted at 9BM beamline of the Advanced Photon Source (APS, Argonne National Laboratory, Lemont, Illinois). The data were processed by Athena and Artemis software incorporated into standard IFEFFIT package.

Techno-Economic Analysis (TEA)

To assess the energy penalty and associated cost induced by $CO_2$ crossover, two benchmark systems from literature were considered: neutral and alkaline $CO_2R$ electrolyzers. These neutral $CO_2R$ MEA and alkaline flow cell electrolyzers were considered specifically owing to their performance metrics—industrially relevant reaction rates (>100 mA/cm$^2$), high FE towards $C_{2+}$ products (i.e. an ethylene FE of >60%), and high full-cell energy efficiency (EE) towards $C_{2+}$ products (i.e. an ethylene full-cell EE of >20%). It was postulated that the proximity of these performance metrics for each system being compared (alkaline, neutral electrolyzers) will help refine the effect of $CO_2$ crossover and carbonate formation on the total energy requirement of producing $C_{2+}$ products (i.e., ethylene). Table 1 summarizes the input parameters to the model for both systems, along with considerations of industrial costs. The majority of these input parameters were obtained from literature. The $CO_2R$ performance of both MEA electrolyzers and alkaline flow cell electrolyzers are still improving, thus it was considered optimistic performance metrics (current density, selectivity, and energy efficiency) towards a single $C_2$ product for each system. The techno-economic model considers a production rate of 1 ton per day, with assumptions that $H_2$ and $O_2$ are the only by-products coming out of the cathodic and anodic streams, respectively. Detailed calculations of cost, along with the main assumptions made, for the capital, installation, operation, carbon regeneration (for alkaline flow cell), cathode separation (for both the alkaline flow cell and MEA electrolyzers), anode separation (for neutral MEA), can be found in previous work (see study of A. Ozden et al., entitled "*Cascade $CO_2$ electroreduction enables efficient carbonate-free production of ethylene*". *Joule*, 5, 706-719 (2021). Table 2 presents the cost breakdown of alkaline flow cell electrolyzers and neutral MEA $CO_2R$ electrolyzers.

Comsol Simulation Modelling

A reaction-diffusion model was used to simulate the local pH using COMSOL Multiphysics software. All the interactions between species in the electrolyte ($CO_2$, $HCO_3^-$, $CO_3^{2-}$, $H_3PO_4$, $H_2PO_4^-$, $HPO_4^{2-}$, $PO_4^{3-}$, $OH^-$, $H^+$ and $H_2O$) were considered. Henry's law was used to calculate the $CO_2$ concentration[1], assuming that the $CO_2$ fugacity is 1 bar.

$$C_{CO2,aq}^0=K_H^0 C_{CO2,gas}^0$$

$K_H^0$ is the Henry's constant, which can be calculated by using the equation below, where T is the temperature.[2]

$$\ln(K_H^0)=93.4517\times\frac{100}{7}-60.2409+23.3585\times\ln\left(\frac{t}{100}\right)$$

Due to the high concentration of the ions, the saturated concentration of $CO_2$ in an electrolyte is corrected using the following equations—see study of S. Weisenberger et al., entitled "*Estimation of gas solubilities in salt solutions at temperatures from* 273 *K to* 363 *K*". *AlChE J.* 42, 298-300 (1996).

$$\log\left(\frac{c_{CO2,aq}^0}{c_{CO2,aq}}\right)=K_s C_s$$

where $K_s=\Sigma(h_{ion}+h_G)$ $$h_G=h_{G,0}+h_T(T-298.15)$$

$C_s$ is the molar concentration and $K_s$ is the Sechenov's constant which can be estimated using equation above and Table 3.

The following homogeneous and heterogenous reactions in the model were considered, which are based on the previously published works (references 27 and 37-42). The heterogenous reactions (reference 43) (reactions 1-4) take place in the porous catalyst layer, and the homogenous reactions (reactions 5-11) occur in entire domain.

$2H_2O+2e^-\rightarrow H_2+2OH^-$
$CO_2+H_2O+2e^-\rightarrow CO+2OH^-$
$CO_2+H_2O+2e^-\rightarrow HCOOH+2OH^-$
$CO_2+H_2O+8e^-\rightarrow CH_4+8OH^-$
$2CO_2+8H_2O+12e^-\rightarrow C_2H_4+12OH^-$
$2CO_2+9H_2O+12e^-\rightarrow C_2H_5OH+12OH^-$
$CO_2+H_2O\leftrightarrow H^++HCO_3^-$
$HCO_3^-\leftrightarrow H^++CO_3^{2-}$
$CO_2+OH^-\leftrightarrow HCO_3^-$
$HCO_3^-+OH^-\leftrightarrow CO_3^{2-}+H_2O$
$H_2O\leftrightarrow H^++OH^-$ The bulk concentrations and pH values were measured experimentally and implemented in the model. The thickness of the diffusion layer was assumed to be 50 μm. The ion species transport is based on the reaction previously listed and follows the equation below. $J_i$ is the molar flux. The species diffusion coefficients are listed in Table 4.

$$\frac{\partial c_i}{\partial t}+\frac{\partial J_i}{\partial x}=R_i$$

$$J_i=-\frac{D_i\partial c_i}{\partial x}$$

The heterogenous reactions were simulated by adding the electrochemical reaction rates to the equation as follow:

$$\frac{\partial c_i}{\partial t}+\frac{\partial J_i}{\partial x}+r_i=R_i$$

-continued $$r_i = \begin{cases} r_{CO_2} = -\frac{i}{F}\left(\frac{FE_{CO}}{2} + \frac{FE_{HCOOH}}{2} + \frac{FE_{CH4}}{8} + \frac{FE_{C2H4}}{12} + \frac{FE_{C2H5OH}}{12}\right) \times \frac{\varepsilon}{L_{catalyst}} \\ r_{OH^-} = \frac{i}{F} \times \frac{\varepsilon}{L_{catalyst}} \end{cases}$$

An average product distribution was assumed, where S is approximated to 40% and X+Y+Z to 60% (Table 5). A porosity of 60%, ε, and length of the catalyst of 300 nm, $L_{catalyst}$, layer was considered in the model.

The descriptions, examples, methods and materials presented in the claims and the specification are not to be construed as limiting but rather as illustrative only.

Meanings of technical and scientific terms used herein are to be commonly understood as by one of ordinary skill in the art to which the disclosure belongs, unless otherwise defined.

It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value. It is commonly accepted that a 10% precision measure is acceptable and encompasses the term "about".

Although various implementations of the disclosure may be described in the context of a single embodiment, these implementations may also be provided separately or in any suitable combination. Conversely, although the disclosure may be described herein in the context of separate embodiments for clarity, the implementations of the techniques described herein may also be implemented in a single embodiment, unless incompatible.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the disclosure shall not be construed as an admission that such reference is available as prior art to the present disclosure.

REFERENCES

The following references are incorporated herein by reference:

1. S. Chu, A. Majumdar, Opportunities and challenges for a sustainable energy future. *Nature* 488, 294-303 (2012).
2. P. De Luna et al., What would it take for renewably powered electrosynthesis to displace petrochemical processes? *Science* 364, eaav3506 (2019).
3. S. Ren et al., Molecular electrocatalysts can mediate fast, selective $CO_2$ reduction in a flow cell. *Science* 365, 367-369 (2019).
4. Y. Wu, Z. Jiang, X. Lu, Y. Liang, H. Wang, Domino electroreduction of $CO_2$ to methanol on a molecular catalyst. *Nature* 575, 639-642 (2019).
5. B. A. Rosen et al., Ionic liquid-mediated selective conversion of $CO_2$ to CO at low overpotentials. *Science* 334, 643-644 (2011).
6. H. Xu et al., Highly selective electrocatalytic $CO_2$ reduction to ethanol by metallic clusters dynamically formed from atomically dispersed copper. *Nat. Energy* 5, 623-632 (2020).
7. F. P. García de Arquer et al., $CO_2$ electrolysis to multicarbon products at activities greater than 1 A $cm^{-2}$. *Science* 367, 661-666 (2020).
8. W. Ma et al., Electrocatalytic reduction of $CO_2$ to ethylene and ethanol through hydrogen-assisted C—C coupling over fluorine-modified copper. *Nat. Catal.* 3, 478-487 (2020).
9. J. A. Rabinowitz, M. W. Kanan, The future of low-temperature carbon dioxide electrolysis depends on solving one basic problem. *Nat. Commun.* 11, 3964 (2020).
10. C.-T. Dinh et al., $CO_2$ electroreduction to ethylene via hydroxide-mediated copper catalysis at an abrupt interface. *Science* 360, 783-787 (2018).
11. T. Haas, R. Krause, R. Weber, M. Demler, G. Schmid, Technical photosynthesis involving $CO_2$ electrolysis and fermentation. *Nat. Catal.* 1, 32-39 (2018).
12. R. B. Kutz et al., Sustainion imidazolium-functionalized polymers for carbon dioxide electrolysis. *Energy Technol.* 5, 929-936 (2017).
13. S. Verma et al., Insights into the low overpotential electroreduction of $CO_2$ to CO on a supported gold catalyst in an alkaline flow electrolyzer. *ACS Energy Lett.* 3, 193-198 (2018).
14. T. T. H. Hoang et al., Nanoporous copper-silver alloys by additive-controlled electrodeposition for the selective electroreduction of $CO_2$ to ethylene and ethanol. *J. Am. Chem. Soc.* 140, 5791-5797 (2018).
15. S. Ma et al., One-step electrosynthesis of ethylene and ethanol from $CO_2$ in an alkaline electrolyzer. *J. Power Sources* 301, 219-228 (2016).
16. D. W. Keith, G. Holmes, D. St. Angelo, K. Heidel, A process for capturing $CO_2$ from the atmosphere. *Joule* 2, 1573-1594 (2018).
17. M. Ma et al., Insights into the carbon balance for $CO_2$ electroreduction on Cu using gas diffusion electrode reactor designs. *Energy Environ. Sci.* 13, 977-985 (2020).
18. F. Li et al., Molecular tuning of $CO_2$-to-ethylene conversion. *Nature* 577, 509-513 (2020).
19. C. J. Bondue, M. Graf, A. Goyal, M. T. M. Koper, Suppression of hydrogen evolution in acidic electrolytes by electrochemical $CO_2$ reduction. *J. Am. Chem. Soc.* 143, 279-285 (2020).
20. Z. Wang, P. Hou, Y. Wang, X. Xiang, P. Kang, Acidic electrochemical reduction of $CO_2$ using nickel nitride on multiwalled carbon nanotube as selective catalyst. *ACS Sustain. Chem. Eng.* 7, 6106-6112 (2019).
21. R. Kortlever, C. Balemans, Y. Kwon, M. T. M. Koper, Electrochemical $CO_2$ reduction to formic acid on a Pd-based formic acid oxidation catalyst. *Catal. Today* 244, 58-62 (2015).
22. H. Ooka, M. C. Figueiredo, M. T. M. Koper, Competition between hydrogen evolution and carbon dioxide reduction on copper electrodes in mildly acidic media. *Langmuir* 33, 9307-9313 (2017).
23. Y. Liu, C. C. L. McCrory, Modulating the mechanism of electrocatalytic $CO_2$ reduction by cobalt phthalocyanine through polymer coordination and encapsulation. *Nat. Commun.* 10, 1683 (2019).

24. Y. Wu et al., Electrochemical $CO_2$ reduction using gas diffusion electrode loading Ni-doped covalent triazine frameworks in acidic electrolytes. *Electrochem.* 88, 359-364 (2020).
25. J. Shen et al., Electrocatalytic reduction of carbon dioxide to carbon monoxide and methane at an immobilized cobalt protoporphyrin. *Nat. Commun.* 6, 8177 (2015).
26. I. Katsounaros et al., The effective surface pH during reactions at the solid-liquid interface. *Electrochem. Commun.* 13, 634-637 (2011).
27. N. Gupta, M. Gattrell, B. MacDougall, Calculation for the cathode surface concentrations in the electrochemical reduction of $CO_2$ in $KHCO_3$ solutions. *J. Appl. Electrochem.* 36, 161-172 (2006).
28. M. Jouny, W. W. Luc, F. Jiao, General techno-economic analysis of $CO_2$ electrolysis systems. *Ind. Eng. Chem. Res.* 57, 2165-2177 (2018).
29. A. Murata, Y. Hori, Product selectivity affected by cationic species in electrochemical reduction of $CO_2$ and CO at a Cu electrode. *Bull. Chem. Soc. Jpn* 64, 123-127 (1991).
30. S. Ringe et al., Understanding cation effects in electrochemical $CO_2$ reduction. *Energy Environ. Sci.* 12, 3001-3014 (2019).
31. J. Resasco et al., Promoter effects of alkali metal cations on the electrochemical reduction of carbon dioxide. *J. Am. Chem. Soc.* 139, 11277-11287 (2017).
32. H. Zimmermann, R. Walzl, in *Ullmann's Encyclopedia of Industrial Chemistry*. (Wiley-VCH, 2009), 10.1002/14356007.a10_045.pub3.
33. J. H. Montoya, C. Shi, K. Chan, J. K. Nørskov, Theoretical insights into a CO dimerization mechanism in $CO_2$ electroreduction. *J. Phys. Chem. Lett.* 6, 2032-2037 (2015).
34. R. B. Sandberg, J. H. Montoya, K. Chan, J. K. Nørskov, CO—CO coupling on Cu facets: Coverage, strain and field effects. *Surf. Sci.* 654, 56-62 (2016).
35. A. Ozden et al., High-rate and efficient ethylene electrosynthesis using a catalyst/promoter/transport layer. *ACS Energy Lett.* 5, 2811-2818 (2020).
36. D. S. Ripatti, T. R. Veltman, M. W. Kanan, Carbon monoxide gas diffusion electrolysis that produces concentrated $C_2$ products with high single-pass conversion. *Joule* 3, 240-256 (2019).
37. C. M. Gabardo et al., Continuous Carbon Dioxide Electroreduction to Concentrated Multi-carbon Products Using a Membrane Electrode Assembly. *Joule* 3, 2777-2791 (2019).
38. T. Burdyny et al, T. & Smith, W. A. $CO_2$ reduction on gas-diffusion electrodes and why catalytic performance must be assessed at commercially-relevant conditions. *Energy Environ. Sci.* 12, 1442-1453 (2019).
39. P. K Das et al., Effective transport coefficients in PEM fuel cell catalyst and gas diffusion layers: Beyond Bruggeman approximation. *Appl. Energy* 87, 2785-2796 (2010).
40. Electrochemical Systems, 3rd Edition (2004).
41. D. M. Bernardi et al., Mathematical model of a gas diffusion electrode bonded to a polymer electrolyte. *AIChE Journal.* 37, 1151-1163 (1991). https://aiche.onlinelibrary.wiley.com/doi/abs/10.1002/aic.690370805
42. B. Kumar et al., New trends in the development of heterogeneous catalysts for electrochemical $CO_2$ reduction. *Catal. Today* 270, 19-30 (2016).
43. Y. Chen et al., Modeling the Performance of A Flow-Through Gas Diffusion Electrode for Electrochemical Reduction of CO or $CO_2$. *J. Electrochem. Soc.* 167, 114503 (2020)

The invention claimed is:

1. An electrolytic system for $CO_2$ electroreduction into multicarbon ($C_2^+$) products, the system comprising:

a cathode being an electrode for $CO_2$ electroreduction, the electrode comprising a substrate, a metal-based catalyst material and a cation-augmenting material, the cathode being provided in a catholyte chamber;

a catholyte being contained in the catholyte chamber for contacting the cathode, said catholyte being an acidic catholyte comprising cation species; wherein the cation-augmenting material comprises an acid group exchanging protons with the cation species of the acid catholyte so as to increase a concentration of the cation species at the surface of the electrode and wherein the acidic catholyte is a strong acid having a pH of at most 1 and comprising phosphoric acid;

an anode being provided in an anolyte chamber;

an anolyte being contained in the anolyte chamber for contacting the anode;

a cationic exchange membrane;

a cathodic inlet in fluid communication with the cathode so as to feed the cathode with a gas component comprising $CO_2$; and a cathodic outlet in fluid communication the catholyte chamber so as to recover a product mixture comprising multicarbon ($C_2^+$) products;

the system being characterized in that the cation species comprises one or more alkali metal ions, said alkali metal of said one or more alkali metal ions being selected from the group consisting of potassium, caesium and sodium, and the acidic catholyte further comprises at least one of chloride, phosphate monobasic, sulfate, iodide, and hydroxide of the selected alkali metal ions, in that the catholyte has an alkali metal ion concentration between 0.5 M and 5 M; and in that the catholyte has a total concentration in phosphorous species ranging between 0.8 M and 1.2 M.

2. The electrolytic system according to claim 1, characterized in that the alkali metal is potassium.

3. The electrolytic system according to claim 1, characterized in that, in the cathode, the metal-based catalyst material comprises or consists of copper and silver.

4. The electrolytic system according to claim 1, characterized in that, in the cathode, the cation-augmenting material comprises or consists of a cationic ionomer.

5. The electrolytic system according to claim 1, characterized in that, in the cathode, the acidic group is —$SO_3H$.

6. The electrolytic system according to claim 1, characterized in that, in the cathode, the cation-augmenting material comprises a cationic perfluorosulfonic acid (PFSA) ionomer.

7. The electrolytic system according to claim 1, characterized in that, in the cathode, the cation-augmenting material further comprises carbon nanoparticles or graphite.

8. The electrolytic system according to claim 1, characterized in that, in the cathode, the substrate is polytetrafluoroethylene (PTFE) that is configured for gas diffusion.

9. The electrolytic system according to claim 1, characterized in that the cationic exchange membrane is membrane of perfluorinated sulfonic acid ionomer.

10. The electrolytic system according to claim 1, characterized in that the cationic exchange membrane is a membrane of perfluoro(2-(2-sulfonylethoxy)propyl vinyl ether)-tetrafluoroethylene copolymer ionomer.

11. The electrolytic system according to claim 1, characterized in that it comprises a reference electrode being provided in the catholyte chamber.

12. A method for enhancing carbon utilization during $CO_2$ electroreduction in an electrolytic system characterized in that the electrolytic system is according to claim 1, and in that the method comprises increasing a local pH of the catholyte at a surface of the cathode, comprising :

creating a local pH gradient from alkaline to acidic conditions from the surface of the cathode to a bulk of the catholyte, wherein the local pH is between 8 and 10 at the surface of the cathode and the local pH is at most 6.5 within a distance of at least 30 μm from the surface of the cathode, and providing cation species at the surface of the cathode, wherein the catholyte comprises a cation donor that liberates the cation species.

13. The method according to claim 12, characterized in that increasing the local pH of the catholyte at the surface of the cathode comprises operating the electrolytic system at a current density that results in a consumption rate of local $H_3O^+$ protons at the surface of the cathode being higher than mass transport of bulk $H_3O^+$ protons.

14. The method according to claim 12, characterized in that providing the cation species at the surface of the cathode comprises confining the cation species within a cation-augmenting layer of the cathode.

* * * * *